US012338569B2

(12) United States Patent
Seo et al.

(10) Patent No.: US 12,338,569 B2
(45) Date of Patent: Jun. 24, 2025

(54) MULTIFUNCTIONAL STORAGE SYSTEM

(71) Applicant: COWAY CO., LTD., Gongju-si (KR)

(72) Inventors: Young Ju Seo, Seoul (KR); Sang Woo Kang, Seoul (KR); Hyun Hee Lee, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 441 days.

(21) Appl. No.: 17/784,600

(22) PCT Filed: Dec. 11, 2020

(86) PCT No.: PCT/KR2020/018206

§ 371 (c)(1),
(2) Date: Jun. 10, 2022

(87) PCT Pub. No.: WO2021/118313

PCT Pub. Date: Jun. 17, 2021

(65) Prior Publication Data

US 2023/0027420 A1 Jan. 26, 2023

(30) Foreign Application Priority Data

Dec. 12, 2019 (KR) ..... 10-2019-0165800
Dec. 12, 2019 (KR) ..... 10-2019-0165823
(Continued)

(51) Int. Cl.
*F24F 8/10* (2021.01)
*D06F 58/10* (2006.01)
(Continued)

(52) U.S. Cl.
CPC ..... *D06F 58/10* (2013.01); *D06F 58/203* (2013.01); *D06F 73/02* (2013.01); *F24F 6/00* (2013.01);
(Continued)

(58) Field of Classification Search
CPC ..... D06F 58/10; D06F 58/203; F24F 6/00; F24F 7/007; F24F 11/0001
See application file for complete search history.

(56) References Cited

U.S. PATENT DOCUMENTS 5,152,077 A 10/1992 Liang
2010/0132209 A1* 6/2010 Park ..... D06F 58/203 34/201
2021/0324566 A1* 10/2021 Oak ..... D06F 58/10

FOREIGN PATENT DOCUMENTS

KR 10-2005-0123442 A 12/2005
KR 20100121201 A * 11/2010
(Continued)

OTHER PUBLICATIONS

International Search Report mailed on Mar. 11, 2021 in PCT/KR2020/018206 filed on Dec. 11, 2020 (2 pages).

*Primary Examiner* — Jorge A Pereiro
*Assistant Examiner* — Michael James Giordano
(74) *Attorney, Agent, or Firm* — Oblon, McClelland, Maier & Neustadt, L.L.P.

(57) ABSTRACT

A multi-functional storage system includes a storage compartment, a circulation flow path positioned at the rear of the storage compartment, and including an inlet end and an outlet end each communicating with the storage compartment, through which circulating air flows, and a flow path inlet for introducing the circulating air into the circulation flow path, the flow path inlet being positioned between the storage compartment and the circulation flow path and in communication with the inlet end of the circulation flow path.

18 Claims, 21 Drawing Sheets

(30) Foreign Application Priority Data

Dec. 12, 2019 (KR) ..... 10-2019-0165858
Dec. 12, 2019 (KR) ..... 10-2019-0165859

(51) Int. Cl.

| | |
|---|---|
| ***D06F 58/20*** | (2006.01) |
| ***D06F 73/02*** | (2006.01) |
| ***F24F 6/00*** | (2006.01) |
| ***F24F 7/007*** | (2006.01) |
| ***F24F 11/00*** | (2018.01) |
| ***F24H 3/02*** | (2022.01) |

(52) U.S. Cl.
CPC ..... *F24F 7/007* (2013.01); *F24F 8/10* (2021.01); *F24F 11/0001* (2013.01); *F24H 3/02* (2013.01)

(56) References Cited

FOREIGN PATENT DOCUMENTS

| | | | | | |
|---|---|---|---|---|---|
| KR | 10-2018-0004028 | A | | 1/2018 | |
| KR | 10-2018-0097326 | A | | 8/2018 | |
| KR | 10-2018-0124746 | A | | 11/2018 | |
| KR | 10-2018-0136806 | A | | 12/2018 | |
| KR | 10-2019-0084569 | A | | 7/2019 | |
| KR | 10-2019-0131258 | A | | 11/2019 | |
| KR | 20190131258 | A | * | 11/2019 | |
| WO | WO-2018208129 | A1 | * | 11/2018 | ..... A47B 61/00 |

* cited by examiner

MULTIFUNCTIONAL STORAGE SYSTEM

TECHNICAL FIELD

The present invention relates to a multi-functional storage system including an inclined flow path inlet, and to a multi-functional storage system in which a flow path inlet for introducing air into a circulation flow path is formed to be inclined.

BACKGROUND

For cabinets that can store various items such as clothes, shoes, blankets, and the like, various technologies (e.g., a.k.a. "clothing care", "clothing treatment" or "clothing cleaning") have been developed, which add a separate mechanical device in the cabinets to remove contaminants or odor substances and improve creases. One example uses high-temperature humidified air that can absorb contaminants or odor substances from clothes.

Korean Laid-Open patent Application No. 10-2018-0124746 by the present inventors proposes a multi-functional storage system capable of simultaneously performing an air cleaning function as well as a clothes management function to remove contaminants or odor substances from clothes and the like.

This multi-functional storage system includes a storage compartment, and a machine compartment positioned below the storage compartment. A humidifying unit and a dehumidifying unit are provided in the machine compartment. When outside air is introduced into the machine compartment, the outside air is heated by the heat generated by the dehumidifying unit and also heated by the humidifying unit such that high-temperature humidified air (referred to as "naturally humidified air") is generated and is introduced into the storage compartment, removing contaminants or odor substances from clothes and the like placed in the storage compartment. When the removal operation is completed, the dehumidifying unit is operated to dehumidify the storage compartment.

In addition, a filter is provided in the machine compartment where the outside air flows in, so that even when the operation to remove contaminants or odor substances from clothes and the like is not performed, the air cleaning operation can be performed, because the introduced outside air is filtered by the filter before being exhausted to the outside. Such an air cleaning operation may be performed simultaneously with, or separately from, an operation of managing clothes and the like.

Like general closet-type furniture, the size of such a multi-functional storage system is relatively large, reaching about 180 cm. This is because the storage compartment should be large enough to accommodate coats, and also, the machine compartment positioned under the storage compartment should be sized to accommodate various components such as a fan for introducing and blowing air, a filter for performing the air purifying function, a water tank where water is replenished for humidification, a water tank where water generated during dehumidification is collected and discarded, and so on.

Furthermore, in the structure in which the machine compartment is positioned at the bottom of the storage compartment, since the natural humidified air flows in and out through only the lower opening inside the storage compartment, a separate fan is needed at the top of the storage compartment in order to circulate the natural humidified air inside the entire storage compartment, which further increases the overall height of the multi-functional storage compartment.

The above factors make it difficult to develop a small-size multi-functional storage system. There is also related art that omits most of the machine compartment and focuses only on simple air flow or ventilation, in which case size reduction is possible, but the effect of removing contaminants or odor substances from clothes and the like is reduced, and the air cleaning function cannot be performed.

In order to solve these problems, a plurality of fans can be used for allowing a sufficient flow of the outside air, thereby enhancing the air cleaning function and the clothes management function in the small-size multi-functional storage system.

However, when a plurality of fans are arranged, there may be a difference in the positions where the outside air is introduced, due to the size of the small-size multi-functional storage system. Due to the difference in the positions where the outside air is introduced, there may be a problem in that the amount of outside air introduced into each of the plurality of fans varies.

Accordingly, there is also a need for a method for enabling a uniform supply to each of a plurality of fans in the small-size multi-functional storage system.

(Patent Literature 1) Korean Laid-Open patent Application No. 10-2018-0124746

(Patent Literature 2) Korean Laid-Open patent Application No. 10-2018-0136806

(Patent Literature 3) Korean Laid-Open patent Application No. 10-2008-0004028

SUMMARY

Technical Problem

The present invention has been made to solve the problems described above, and it is intended to propose a small-size multi-functional storage system. Since it is difficult to reduce the height of the storage compartment, it is intended to propose a multi-functional storage system that can be small-sized while maintaining the height of the storage compartment, using various methods such as changing the arrangement of the machine compartment, adjusting the air path, and the like. It goes without saying that it is intended to propose a multi-functional storage system capable of maintaining the clothes management function and the air cleaning function irrespective of size reduction.

In addition, it is intended to propose an arrangement inside a multi-functional storage system, which may be adopted when using a plurality of fans.

In addition, it is intended to propose a method for uniformly supplying outside air that is introduced into each of a plurality of fans, when the plurality of fans are used.

In particular, since it is difficult to reduce the height of the storage compartment, it is intended to propose a method suitable for a small-size multi-functional storage system and for uniformly supplying outside air that is introduced into each of the plurality of fans, using various methods such as changing the arrangement of the machine compartment, adjusting the air path, and the like, while maintaining the height of the storage compartment.

It goes without saying that the present inventors aim to propose a multi-functional storage system capable of maintaining the clothes management function and the air cleaning function irrespective of the size reduction.

In addition, it is intended to propose a multi-functional storage system capable of controlling a flow of air supplied to a plurality of fans.

In addition, it is intended to propose a multi-functional storage system capable of effectively removing dust from clothes and the like stored in a storage space, while maximizing space utilization and improving power efficiency, by using and controlling a plurality of fans.

Technical Solution

In an embodiment of the present invention for solving the problems described above, a multi-functional storage system is provided, which may include a storage compartment 180, a circulation flow path 400 positioned at the rear of the storage compartment 180, and including an inlet end and an outlet end each communicating with the storage compartment 180, through which circulating air flows, and a flow path inlet 300 for introducing the circulating air into the circulation flow path 400, the flow path inlet 300 being positioned between the storage compartment 180 and the circulation flow path 400 and in communication with the inlet end of the circulation flow path 400, in which the circulation flow path 400 is formed to extend upward, and the flow path inlet 300 is a space formed between a rear surface of the storage compartment 180 and a front surface of the circulation flow path 400 and including at least a portion tapered upward.

According to an embodiment, the flow path inlet 300 may be formed in a shape corresponding to shapes of the rear surface of the storage compartment 180 and the front surface of the circulation flow path 400, and a horizontal cross-sectional area of an upper portion may be formed to be smaller than a horizontal cross-sectional area of a lower portion.

According to an embodiment, the circulation flow path 400 may include a plurality of fans 420 communicating with the flow path inlet 300, the plurality of fans (420) including a first fan 421 communicating with the lower portion of the flow path inlet 300, and a second fan 422 communicating with the upper portion of the flow path inlet 300, and the first fan 421 and the second fan 422 may be configured to suck in the circulating air introduced into the flow path inlet 300 in a horizontal direction and supply it onto the circulation flow path 400.

According to an embodiment, the rear surface of the storage compartment 180 may include an inclined portion 180*a* including a portion facing the second fan 422 and configured to be inclined toward the front surface of the circulation flow path 400, and the flow path inlet 300 may be formed so as to be decreased in cross-sectional area by the inclined portion 180*a* in the horizontal direction toward the upper side.

According to an embodiment, an inclination angle of the inclined portion 180*a* toward the circulation flow path 400 may vary according to an output of each of the first fan 421 and the second fan 422.

According to an embodiment, the circulation flow path 400 may include the plurality of fans 420 communicating with the flow path inlet 300, and the plurality of fans 420 may be arranged at different heights from one another, and arranged in a mutually diagonal direction.

According to an embodiment, the inclined portion 180*a* may be configured to be inclined toward the front surface of the circulation flow path 400, and also inclined in a diagonal direction to correspond to the first fan 421 and the second fan 422 arranged in the mutually diagonal direction.

According to an embodiment, the system may further include a humidifying unit 200 having one end communicating with the flow path inlet 300 and the other end communicating with the lower portion of the storage compartment 180, in which the humidifying unit 200 may include a flow path formed such that the circulating air flows sequentially through the storage compartment 180, the humidifying unit 200, and the flow path inlet 300, and the humidified air formed as passing through the humidifying unit 200 may be introduced into the flow path inlet 300.

According to an embodiment, the circulation flow path 400 may include a plurality of fans 420 communicating with the flow path inlet 300, in which the plurality of fans 420 may include first to N-th fans, and each of the first to N-th fans may be formed to discharge air to first to N-th positions in the space inside the storage compartment 180, and outputs of the first to N-th fans may be each independently controlled.

According to an embodiment, the plurality of fans 420 may be configured to discharge air upwardly onto the circulation flow path 400, and each of the first to N-th fans may be provided at different positions with respect to a plane.

According to an embodiment, the system may further include a guide flow path partition wall 440 extending on the circulation flow path 400 and dividing the circulation flow path 400 such that the circulating air introduced by each of the plurality of fans 420 is divided and flows, and an extension length of the guide flow path partition wall 440 on the circulation flow path 400 may be determined according to the outputs and positions of the plurality of fans 420.

According to an embodiment, the plurality of fans 420 may include a first fan 421 and a second fan 422 provided at different heights on the circulation flow path 400, and each of the first fan 421 and the second fan 422 may be in communication with each of divided portions on the circulation flow path 400 divided by the guide flow path partition wall 440 to discharge air to a first position and a second position in the space inside the storage compartment 180, respectively.

According to an embodiment, the multi-functional storage system may have a dusting mode, in which the outputs of the first fan 421 and the second fan 422 may be set differently and varied, and it may be repeated that the output of one of the first fan 421 and the second fan 422 is set higher than the other output and then set lower than the other output.

According to an embodiment, the multi-functional storage system may have a decontaminating mode, in which any one of the first fan 421 and the second fan 422 may be set to have a higher output than the other.

According to an embodiment, the multi-functional storage system may have a dewrinkling mode, in which the outputs of the first fan 421 and the second fan 422 may each be set to be the same.

According to an embodiment, The guide flow path partition wall 440 may include a variable partition wall 441 that is formed as a part of the guide flow path partition wall 440 and is relatively rotatable with respect to the guide flow path partition wall 440 about the rotation shaft 442, and closes any one of the divided portions of the circulation flow path 400 by relative rotation of the variable partition wall 441 with respect to the guide flow path partition wall 440.

According to an embodiment, the multi-functional storage system may have a decontaminating mode, in which the variable partition wall 441 may close any one of the divided portions of the circulation flow path 400, and the output of the fan 420 positioned opposite to the divided portion closed by the variable partition wall 441 may be increased, and a dusting mode, in which the variable partition wall 441 alternately closes any one of the divided portions of the circulation flow path 400, and it is repeated that the output of the fan 420 positioned opposite to the divided portion closed by the variable partition wall 441 is increased, and the output of the fan 420 positioned in the divided portion is decreased.

According to an embodiment, the system may include a heating unit 450 installed in the circulation flow path 400 and configured to heat the passing air.

According to an embodiment, the inlet end of the circulation flow path 400 may be in communication with a lower portion of the storage compartment 180 through a humidifying unit 200, the outlet end of the circulation flow path 400 may be in communication with an upper portion of the storage compartment 180 through a variable flow path module 500, a portion of the humidifying unit 200 may be positioned in the lower portion of the storage compartment 180, a portion of the variable flow path module 500 may be positioned above the storage compartment 180, and a machine compartment including another portion of the humidifying unit 200, another portion of the variable flow path module 500, and the circulation flow path 400 may be positioned at the rear of the storage compartment 180.

According to an embodiment, the variable flow path module 500 may include an exhaust flow path 520 that can be selectively opened and closed.

According to an embodiment, the system may further include a filter 151 positioned on one surface of the storage compartment 180 in contact with the outside air, and a door 150 of the storage compartment 180 may be provided on an outer surface of the storage compartment 180 that has the filter 151 positioned therein.

According to an embodiment, the system may further include a lower flow path 163 communicating with the flow path inlet 300 to allow the outside air to be directly introduced into the flow path inlet 300 without being introduced into the storage compartment 180, a lower filter 161 may be installed on the lower flow path 163, the lower filter 161 being positioned in a portion other than the outer surface of the storage compartment 180, a portion of the outside air may be introduced through the filter 151 and then pass through the storage compartment 180, the humidifying unit 200, and the flow path inlet 300 sequentially to reach the circulation flow path 400, and another portion of the outside air may be introduced through the lower filter 161 and then pass through the flow path inlet 300 to reach the circulation flow path 400.

In addition, the present invention provides a method for managing clothes using the multi-functional storage system described above.

In addition, the present invention provides a method for cleaning air using the multi-functional storage system described above.

In addition, the present invention is a method using the multi-functional storage system described above, which may include steps, in which (a) the outside air is introduced into the storage compartment 180, (b) the introduced outside air is introduced into the circulation flow path 400 positioned at the rear of the storage compartment 180 and flows as circulating air, and (c) the circulating air flowing in the circulation flow path 400 is introduced back into the storage compartment 180.

According to an embodiment, step (b) may include steps in which (b1) the introduced outside air is introduced into a humidifying unit 200 and flows as circulating air for humidification, (b2) the humidified circulating air is introduced into the flow path inlet 300, and (b3) the circulating air introduced into the flow path inlet 300 is passed through the plurality of fans 420 and introduced into the circulation flow path 400 and flows, and step (b3) may include steps in which (b31) the circulating air introduced into the flow path inlet 300 is introduced into each of the plurality of fans 420, (b32) the circulating air introduced into each of the plurality of fans 420 is divided through a portion of the circulation flow path 400 divided by a guide flow path partition wall 440 and flows, and (b33) the circulating air flowing in the portion of the circulation flow path 400 is joined with another portion of the circulation flow path 400 and flows together.

According to an embodiment, step (c) may include steps, in which (c1) the circulating air flowing in the circulation flow path 400 is introduced into a variable flow path module 500 and flows, and (c2) the circulating air flowing in the variable flow path module 500 is introduced back into the storage compartment 180, and step (c2) may optionally include steps, in which (c21) a portion of the circulating air flowing in the variable flow path module 500 is exhausted to the outside through an exhaust flow path 520, and (c22) another portion of the circulating air flowing in the variable flow path module 500 is introduced back into the storage compartment 180.

In addition, the present invention is a method using the multi-functional storage system described above, which may include (x) performing a circulating mode, and (y) performing an air ventilation and cleaning mode, in which step (x) may include steps, in which the outside air is introduced into the storage compartment 180 through a filter 151 positioned on one surface of the storage compartment 180 in contact with the outside air, the introduced outside air as circulating air is humidified by a humidifying unit 200, and then introduced into the circulation flow path 400 positioned at the rear of the storage compartment 180 and flows, wherein, while flowing, the air is heated by a heating unit 450, and the circulating air flowing in the circulation flow path 400 is introduced back into the storage compartment 180 through a variable flow path module 500, and step (y) may include steps, in which the outside air is introduced into the storage compartment 180 through the filter 151, the introduced outside air is introduced into the circulation flow path 400 and flows as circulating air, and the circulating air flowing in the circulation flow path 400 is introduced into the variable flow path module 500, and a portion of the circulating air is exhausted to the outside through an exhaust flow path 520 positioned in the variable flow path module 500, and another portion of the circulating air is introduced back into the storage compartment 180.

According to an embodiment, the method may further include (z) performing a cleaning mode, in which step (z) may include steps, in which the outside air is introduced into the storage compartment 180 through the filter 151, the introduced outside air is introduced into the circulation flow path 400 and flows as circulating air, and the circulating air flowing in the circulation flow path 400 is introduced into the variable flow path module 500 and exhausted through the exhaust flow path 520 to the outside.

According to an embodiment, the method may further include (z) performing a cleaning mode, in which step (z) may include steps, in which the outside air is introduced into the flow path inlet 300 through a lower filter 161, and the outside air introduced into the flow path inlet 300 is introduced into the circulation flow path 400 and exhausted to the outside through the exhaust flow path 520.

Advantageous Effects

According to the present invention, it is possible to provide a small-size multi-functional storage system with a low height. At the same time, there is no deterioration in the function of a general multi-functional storage system. This is possible by adopting a method in which the machine compartment is positioned at the rear of the storage compartment, and outside air is directly introduced into the storage compartment.

While the circulating air flows at a relatively high speed along the circulation flow path, humidified air of high temperature is naturally generated by the appropriately arranged humidifying unit and heating unit. This does not interfere with the flow path or in misalignment with the pressure arrangement, thereby reducing the load applied on the machine part and extending life thereof.

In addition, according to the present invention, by applying a plurality of fans positioned at different heights for high-speed flow of circulating air in a limited space, it is possible to reduce the size of a multi-functional storage system, as well as generate a complex flow, thereby increasing the effect of removing contaminants from clothes, and by providing the inclined flow path inlet, it is also possible to minimize interference between a plurality of fans, thereby maximizing fan efficiency.

Through the cleaning mode, the system can be used as an air purifier when the circulating mode is not used. In addition, the flow through the inside of the storage compartment may be selectively adopted according to the selection of the user or according to the quality of outside air.

While using a plurality of fans, it is possible to uniformly supply outside air introduced to each of the plurality of fans.

In addition, by adjusting the length of the partition wall positioned in the circulation flow path, it is possible to control the flow of air discharged from the plurality of fans.

Since various modes of the multi-functional storage system can be implemented, it is possible to efficiently remove dust, wrinkles, odors, and the like from clothes and the like stored in the storage space.

DETAILED DESCRIPTION

Figure 1:
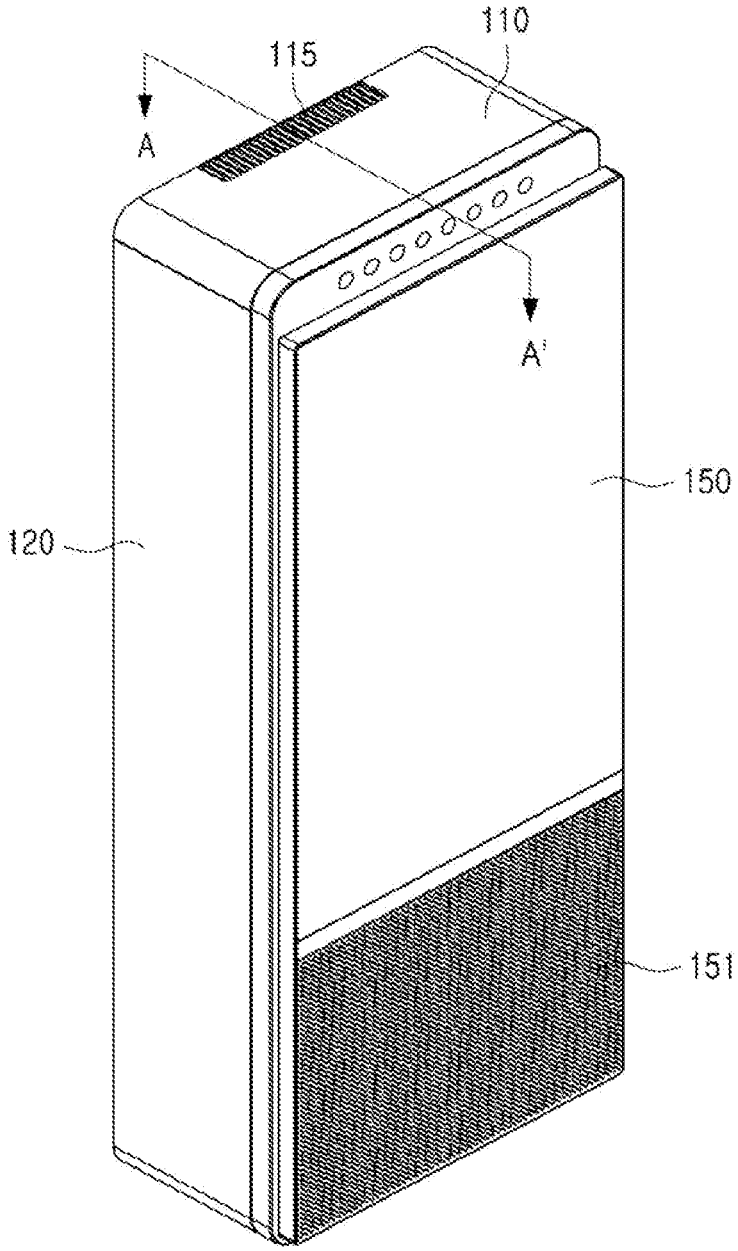
FIG. 1 is a front perspective view of a multi-functional storage system according to the present invention.

Hereinafter, a multi-functional storage system according to the present invention will be described with reference to the drawings.

Hereinafter, "front", "front surface", or "forward" refers to a portion or direction at which the door of the multi-functional storage system is positioned, and refer to the portion that faces a user who is using the same and the direction toward that portion, and "rear", "rear surface", or "rearward" refers to a portion or a direction opposite to the front or front surface. However, it should be understood that this is for the purpose of explanation, and slight modifications in the direction should be understood as being included within the scope of the present invention as long as they do not depart from the concept of the present invention presented in the claims.

Hereinafter, "circulating air" generally refers to introduced air in the multi-functional storage system. Once introduced into the multi-functional storage system, the outside air continuously circulates throughout the flow path that includes the storage compartment, and this circulating air is referred to as the circulating air. A portion of the circulating air is exhausted to the outside as clean air, in which case the air before being exhausted is also referred to as the circulating air.

Hereinafter, "power" of a fan refers to a value that varies according to the size and the rotation per minute of the fan, and controlling the output of the fan generally refers to controlling the power of a fan, or to controlling the rotation speed of a fan using other members, although not limited thereto.

1. Description of Concept and Overall Structure of Multi-Functional Storage System First, a technical concept necessary for reducing a size of a multi-functional storage system while maintaining functions thereof in accordance with the present invention will be described.

The present invention proposes a multi-functional storage system, in which outside air is directly introduced into a storage compartment 180 and the introduced outside air continuously circulates and flows through a circulation flow path 400 positioned at the rear of the storage compartment 180. That is, the storage compartment 180 is in communication with the circulation flow path 400, where "communication" is a concept including not only a connection of parts in direct contact with one another, but also an indirect connection that allows fluid communication. For example, an inlet end of the circulation flow path 400 is in communication with the lower portion of the storage compartment 180 through the humidifying unit 200, and the outlet end of the circulation flow path 400 is in communication with an upper portion of the storage compartment 180 through a variable flow path module 500.

For size reduction, it is important that the circulation flow path 400 is positioned at the rear of the storage compartment 180. One of the difficulties in reducing the size of the multi-functional storage system is the machine compartment that is positioned below the storage compartment 180, and by changing the position of the machine compartment to the rear of the storage compartment 180, the height of the multi-functional storage system can be reduced. However, certain parts may not be changed to the rear of the storage compartment 180. For example, a water tank 210 of the humidifying unit 200, which should be continuously replenished with water by the user, is preferably positioned in the front rather than the rear of the storage compartment 180. In addition, a portion of the variable flow path module 500 that serves as a path through which the circulating air is introduced into the storage compartment 180 cannot be positioned at the rear of the storage compartment 180 due to its structure.

In addition, for size reduction, the position of a flow path inlet 300 is also important. The storage compartment 180 is shaped such that its cross-sectional area in the horizontal direction is narrowed downward, and the flow path inlet 300 is positioned in a space located between an outermost edge and an innermost edge of the storage compartment 180. Through this, there is no need to secure a separate space for installing the flow path inlet 300.

The details will be described below.

Figure 2:
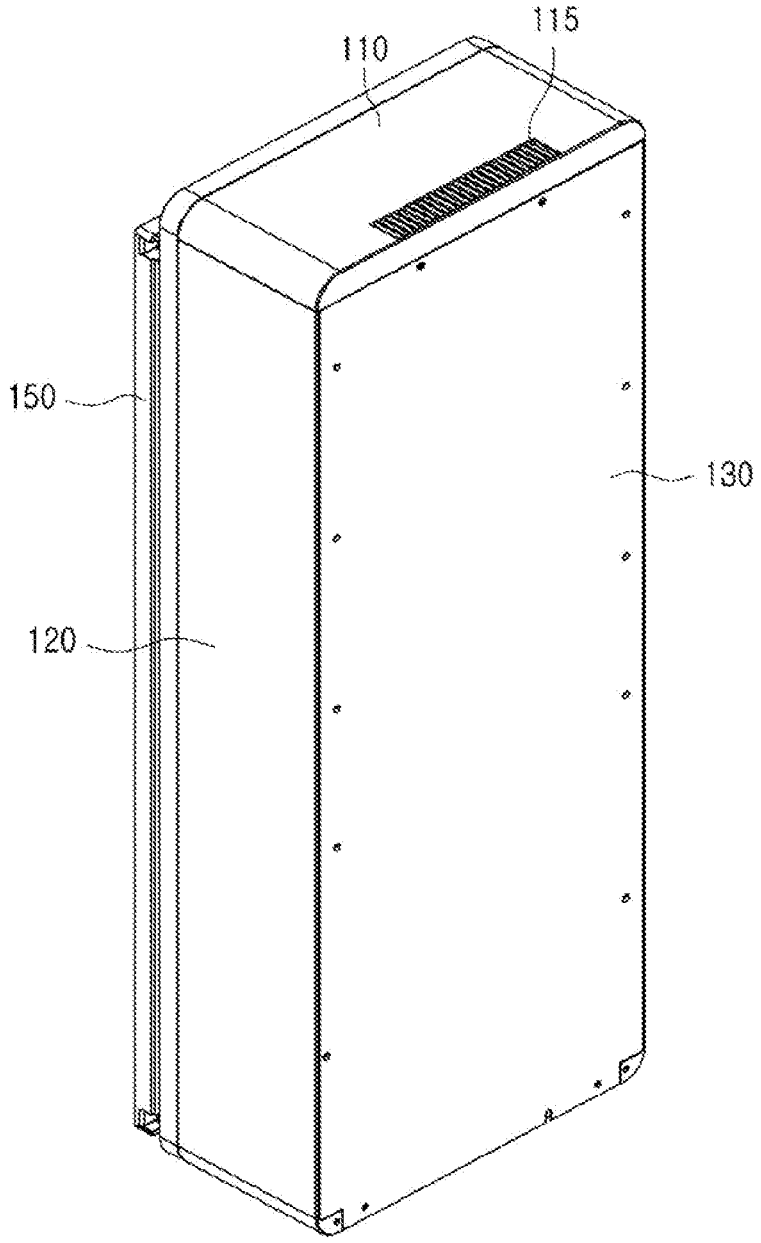
FIG. 2 is a rear perspective view of the multi-functional storage system according to the present invention.

An outer surface and components of the multi-functional storage system according to the present invention will be schematically described with reference to FIGS. 1 and 2.

An upper surface 110 is provided on the upper part of the multi-functional storage system, with an exhaust grill 115 positioned thereon, allowing exhaustion of a portion of the air circulating in the multi-functional storage system or clean air filtered in the multi-functional storage system to the outside. The exhaust grill 115 is connected to an exhaust flow path 520 to be described below.

The multi-functional storage system includes side surfaces 120 provided on each side, a rear surface 130 provided at the rear, and a base 140 positioned below.

A door 150 is provided at the front of the multi-functional storage system. The door 150 may be hingedly opened and closed, and its exterior may be made of a material that reflects light such as a mirror, but is not limited thereto. An operation panel or a display (not illustrated) operated by a user may be positioned outside the door 150.

Figure 3:
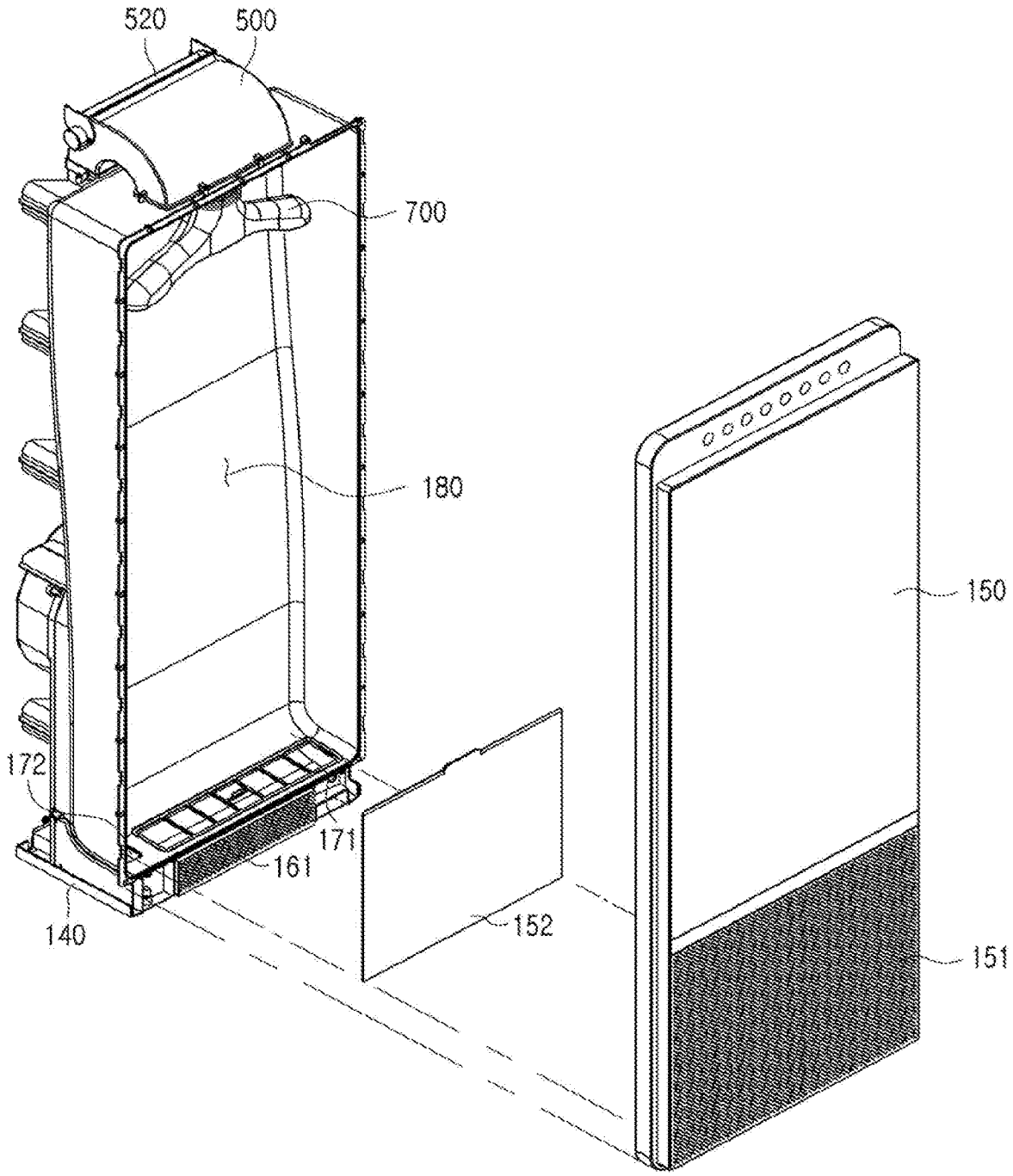
FIG. 3 is a front exploded perspective view of the multi-functional storage system with an exterior panel removed, according to the present invention.
Figure 4:
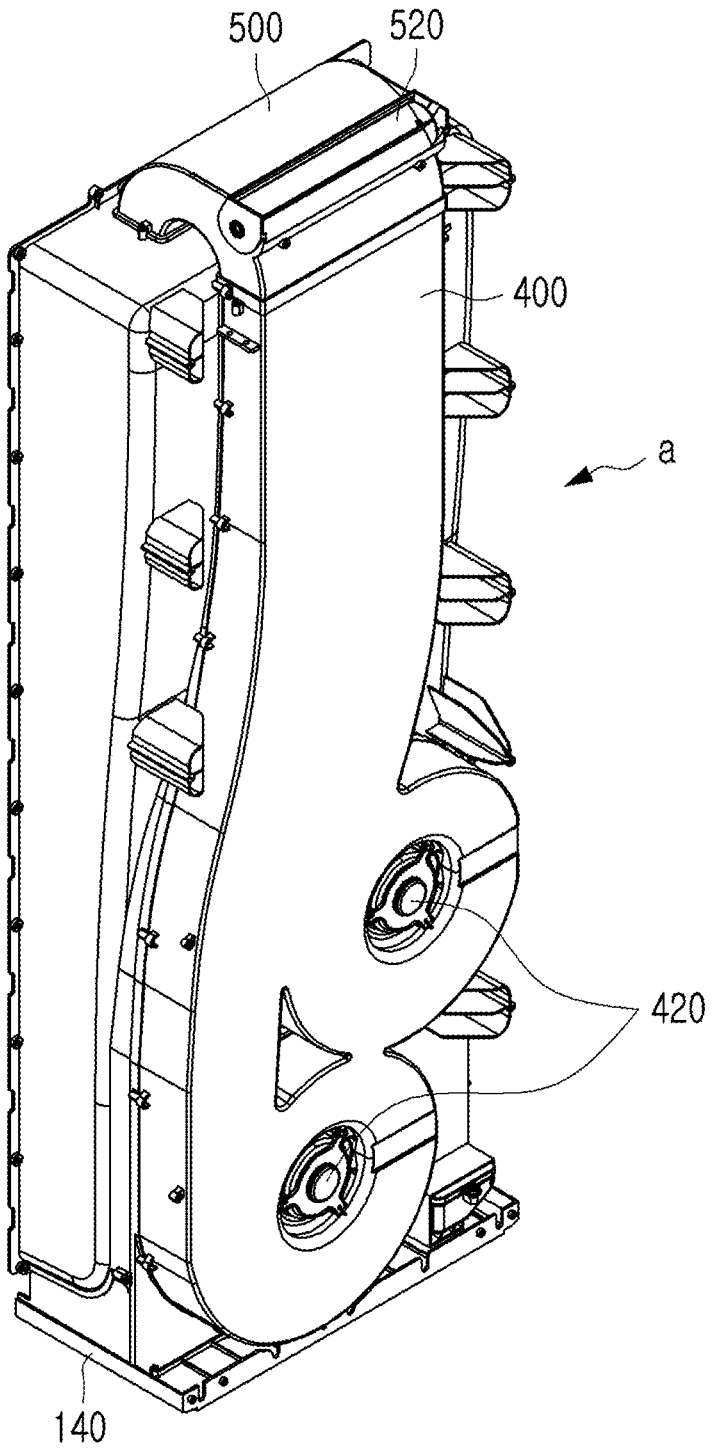
FIG. 4 is a rear exploded perspective view of the multi-functional storage system with the exterior panel removed, according to the present invention.

The components of the multi-functional storage system according to the present invention will be schematically described with reference to FIGS. 3 to 5. In FIGS. 3 and 4, the illustration of the upper surface 110, the side surfaces 120, and the rear surface 130 is omitted for the purpose of explanation.

A filter 151 for filtering the outside air is provided below the door 150 provided at the front of the multi-functional storage system. A filter door 152 may be positioned inside the filter 151 to control the degree of opening of the filter door 152, thereby controlling an amount of filtered outside air. For example, the filter door 152 may be closed to block the outside air such that only the internal circulation is allowed. The filter door 152 may be controlled differently according to various operating modes of the multi-functional storage system of the present invention, which will be described below.

When the user removes the door 150 from the outside, the storage compartment 180 with one side open is exposed to allow the user access. A flow path guide 600 may be positioned on an upper inner surface of the storage compartment 180, and the flow path guide 600 may include a portion for discharging the circulating air into the storage compartment, and a portion attached to a clothes hanger 700 to discharge the circulating air into the clothes hanger (that is, toward the lining of the clothes hanger mounted). The flow path guide 600 and the clothes hanger 700 will be described below with reference to FIGS. 17 and 18.

In one embodiment of the present invention, a separate lower filter 161 may be positioned at a lower side of the door 150 at the front of the multi-functional storage system, through which the outside air may be be additionally introduced. The air introduced through the lower filter 161 may flow toward the flow path inlet 300 to be described below without being introduced into the storage compartment 180, or may flow together as the circulating air through the storage compartment 180.

A storage compartment filter 171 and a humidifying unit inlet 172 are positioned on a lower inner surface of the storage compartment 180. The storage compartment filter 171 filters contaminants such as dust and the like separated in the storage compartment 180. The user can detach the storage compartment filter 171 and then attach it back after cleaning. The humidifying unit inlet 172 is an opening through which the circulating air inside the storage compartment 180 is discharged to the outside of the storage compartment 180, and it is connected to the humidifying unit 200. When pressure is formed in the flow path by a fan 420 to be described below, the air inside the storage compartment 180 is naturally directed to the humidifying unit 200 through the humidifying unit inlet 172. The humidifying unit 200 will be described below with reference to FIGS. 10 to 12.

The circulating air introduced into the humidifying unit 200 is humidified and flows to the flow path inlet 300.

The circulating air introduced into the flow path inlet 300, that is, the humidified circulating air is introduced into the circulation flow path 400. The circulation flow path 400 is positioned at the rear of the storage compartment 180, and includes a plurality of fans 420 that provide power for circulating and flowing air. In addition, a heating unit 450 is provided to heat the circulating air. In the example illustrated in FIGS. 4 and 5, the circulating air rises along the circulation flow path 400.

The circulating air flowing in the circulation flow path 400 reaches the variable flow path module 500. The exhaust flow path 520 may be branched off from one side of the variable flow path module 500 for exhausting a portion of the circulating air to the outside. One end of the variable flow path module 500 is connected to the flow path guide 600 such that circulating air is introduced into the storage compartment 180.

Figure 6:
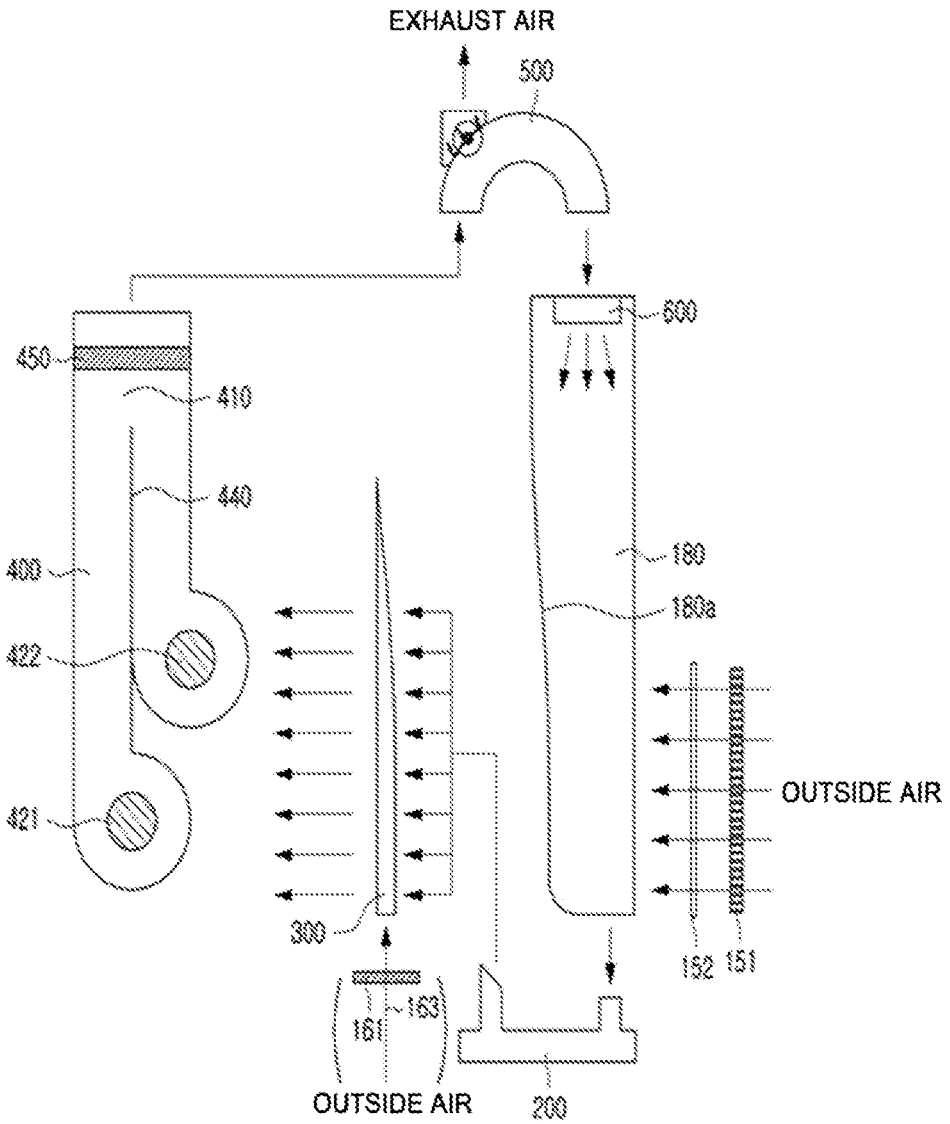
FIG. 6 is a conceptual view provided to explain a flow path of the multi-functional storage system according to the present invention.

In this way, the circulating air continuously circulates through the flow path in the multi-functional storage system, which will be described in more detail with reference to FIG. 6.

2. Description of Flow Path of Multi-Functional Storage System

The flow path of the multi-functional storage system according to the present invention will be described with reference to FIG. 6. In FIG. 6, the main components are separated and connected with arrows for the purpose of explanation, in which the arrows are provided not to indicate a separate flow path, but to describe the flow of the air, and each of the components may be directly connected to one another.

When the fan 420 operates, the outside air is introduced or the circulating air starts to flow.

A negative pressure is formed inside the storage compartment 180 by the operation of the fan 420, thus drawing in the outside air that passed the filter 151 through the filter door 152 that may be partially or fully open. When the filter door 152 is closed, the outside air is of course not introduced, and only the circulating air in the flow path may keep circulating, or in an embodiment of the present invention, the outside air may be introduced through the lower filter 161.

Due to the pressure difference formed by the operation of the fan 420, the outside air introduced into the storage compartment 180 flows toward the humidifying unit 200 as the circulating air. The humidifying unit 200 humidifies the circulating air.

In this case, it is important that the humidifying unit 200 is designed and included as a part of the flow path of the circulating air rather than it is branched off from the entire flow path of the circulating air. When the humidifying unit is branched off from the flow path of the circulating air and positioned, since the pressure in the flow path of the circulating air by the operation of the fan 420 is higher than the pressure in the humidifying unit 200, the humidified air generated by the humidifying unit is not introduced into the flow path of the circulating air, but rather the circulating air flows back to the humidifying unit 200. In the present invention, in order to prevent this, the humidifying unit 200 is included as a part of the flow path of the circulating air, and in particular, as will be described below, a lower end of a humidifying unit exhaust flow path 230 of the humidifying unit 200 is disposed so as to be submerged under the water surface in the water tank 210.

Meanwhile, the circulating air humidified by the humidifying unit 200 is discharged from the humidifying unit 200 and introduced into the flow path inlet 300. Likewise, this is due to the pressure difference formed by the operation of the fan 420.

The circulating air introduced into the flow path inlet 300 is introduced into the circulation flow path 400, and then passes through the fan 420 to reach a guide flow path 410. When the plurality of fans 420 are provided, the air passing through each fan flows through a respective independent flow path separated by a guide flow path partition wall 440, and is joined in the guide flow path 410 where there is no guide flow path partition wall 440 present. The heating unit 450 is at this position to heat the circulating air.

The heated circulating air is introduced into the variable flow path module 500. All or part of the circulating air may be exhausted according to the operation of the variable flow path module 500, or all or part of the circulating air is introduced back into the storage compartment 180 through the flow path guide 600 and circulated.

The circulating air introduced into the storage compartment 180 is introduced back into the humidifying unit 200 together with the introduced outside air (when the filter door 152 is partially or fully open) or without the introduced outside air (when the filter door 152 is closed), and in this way, the circulating air continuously circulates until the operation of the fan 420 is stopped.

Meanwhile, in an embodiment of the present invention, the outside air may be further introduced through the lower filter 161. The outside air introduced through the lower filter 161 may be directly introduced into the flow path inlet 300 through a lower flow path 163 as circulating air, without being introduced into the storage compartment 180 and the humidifying unit 200. In another embodiment, the outside air introduced through the lower filter 161 may be introduced into the storage compartment 180 and then introduced into the flow path inlet 300 through the humidifying unit 200.

3. Description of Each Component of Multi-Functional Storage System 3.1 Storage Compartment 180

Figure 7:
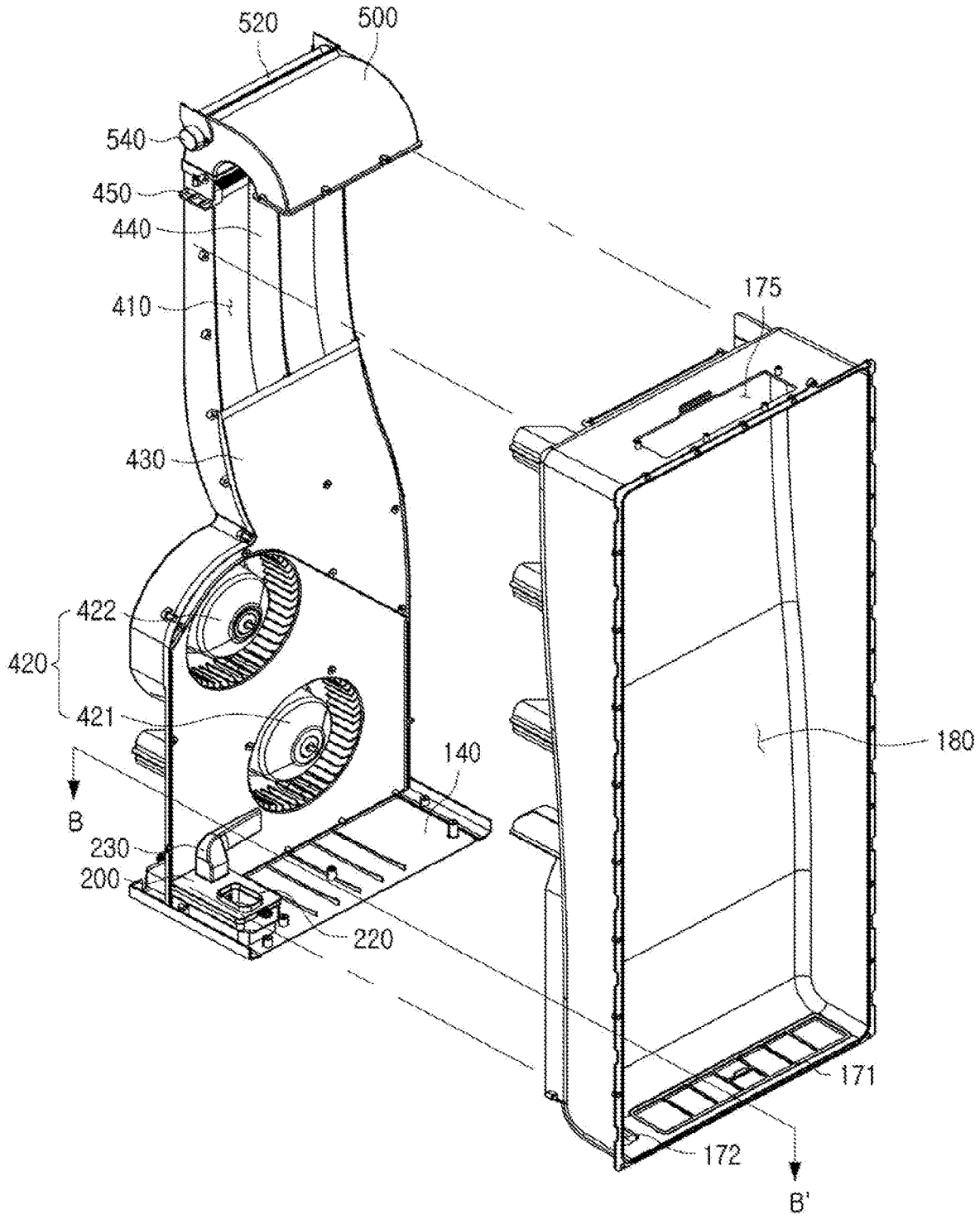
FIG. 7 is a front exploded perspective view of the multi-functional storage system according to the present invention, with some parts omitted and the storage compartment separated.
Figure 8:
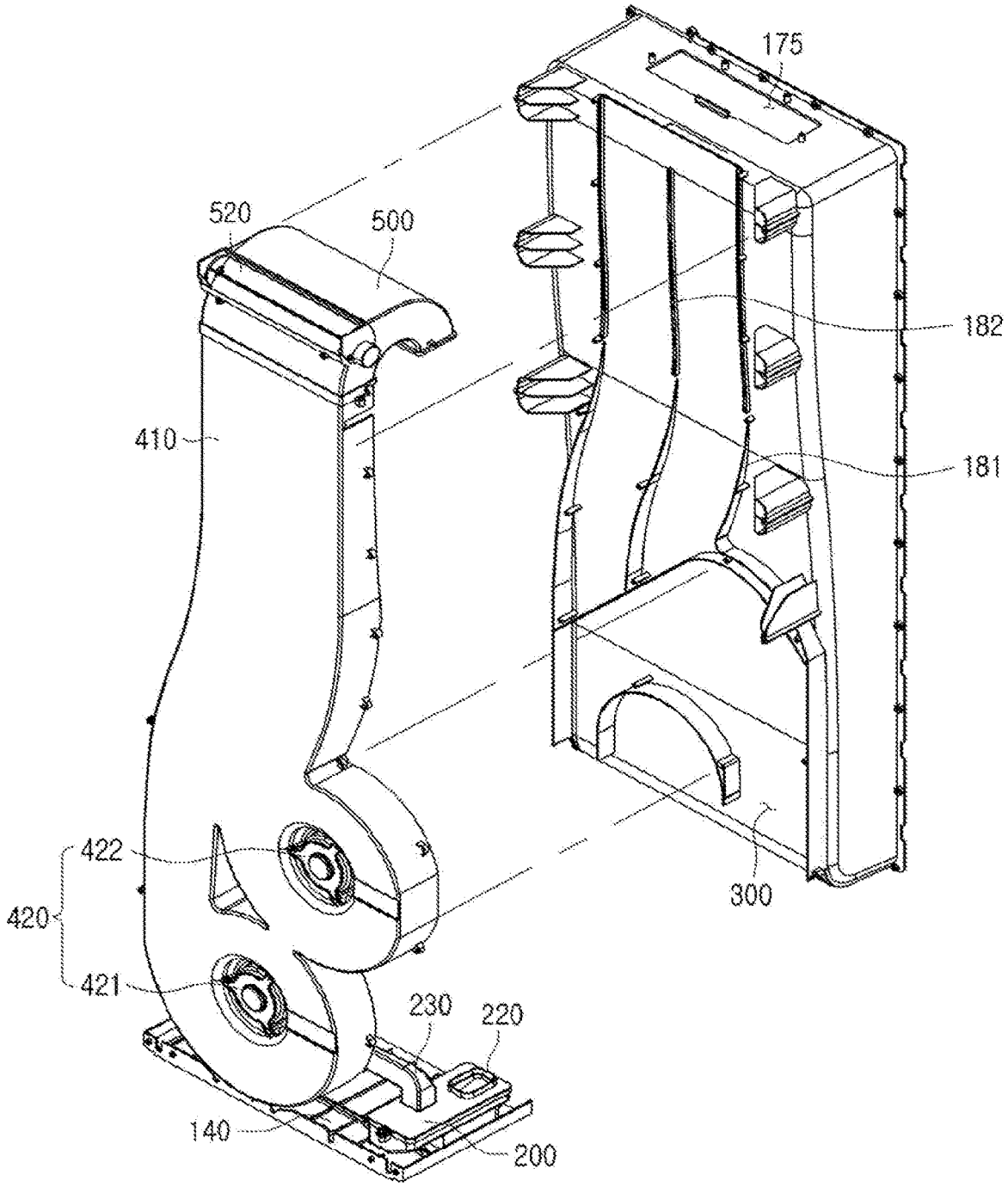
FIG. 8 is a rear exploded perspective view of the multi-functional storage system according to the present invention, with some parts omitted and the storage compartment separated.

The storage compartment 180 will be described with reference to FIGS. 7 and 8.

The storage compartment 180 is a space in which clothes are stored, and includes, provided on the upper inner surface, the clothes hangers 700 for hanging clothes, and an upper opening 175 having the flow path guide 600 for discharging air into the storage compartment 180 or into the clothes hanger 700.

On the lower inner surface of the storage compartment 180, there are the storage compartment filter 171 that filters out contaminants such as dust and the like in the storage compartment 180, and the humidifying unit inlet 172 for introducing circulating air into the humidifying unit 200. The humidifying unit inlet 172 is airtightly connected to a humidifying unit inlet flow path 220 of the humidifying unit 200.

The upper opening 175 and the humidifying unit inlet 172 are the open areas through which air can flow inside the storage compartment 180, in which the upper opening 175 is the area for introducing the circulating air into the storage compartment 180, and the humidifying unit inlet 172 is the area for discharging the circulating air to the outside of the storage compartment 180.

Meanwhile, the horizontal cross-sectional area of the storage compartment 180 is in a shape that is gradually narrowed from the upper side to the lower side. This provides the following three advantages.

First, the area that decreases downward can cause a pressure difference, which may cause a natural downward flow of the circulating air. That is, since the circulating air flows downward like a kind of shower (so-called, "air shower") in the storage compartment 180, it is suitable to shake off contaminants from clothes and the like downward. Note that an upward flow can cause the dust and the like to rise and attached back to the clothes.

Second, the change of the cross-sectional area in the horizontal direction complicates the air flow in the storage compartment 180. A vortex is formed or a flow in random direction is formed. As such, when the air flow in the storage compartment 180 is complicated, the clothes stored in the storage compartment 180 can be shaken in various directions, which is effective in removing contaminants, and the circulating air (heated and humidified air) can be evenly distributed throughout the clothes, thereby increasing the cleaning effect of the clothes.

Third, considering the rectangular parallelepiped shape of the multi-functional storage system, a space for accommodating the mechanical components is formed outside the lower portion where the storage compartment air is narrow. The multi-functional storage system for size reduction is designed according to the present invention, in which, since the machine compartment generally provided at the bottom of the storage compartment is omitted, it is important to secure a space to accommodate the mechanical components (e.g., the flow path inlet 300), and it is possible to provide such space by changing the area of the storage compartment 180.

In the drawing, in consideration of the door 150 which is planar, one side (front side) of the storage compartment 180 has a vertical shape and the other side (inside) has a curved shape.

In another embodiment, the horizontal cross-sectional area of the storage compartment 180 may be in such a shape that gradually widens downward, or a shape that repeatedly narrows and widens downward. In this case, the second and third advantages described above can be obtained as they are. It may be difficult to obtain the first advantage, that is the natural downward flow, but this can be overcome by changing the RPM, output, and the like of the fan 420.

Referring to the rear surface of the storage compartment 180, a lower portion of the rear surface forms one surface of the flow path inlet 300, and an upper portion of the rear surface forms one surface of the circulation flow path 400.

In order to form the flow path inlet 300, a guide flow path guide part 181 is positioned below at the rear of the storage compartment 180. The guide flow path guide part 181 protrudes backward from the rear surface of the storage compartment 180 and is in airtight contact with a separation plate 430 of the circulation flow path 400 to form a flow path inlet part 300.

In order to form the circulation flow path 400, a partition wall guide part 182 is positioned above the rear surface of the storage compartment 180 forming one surface of the circulation flow path 400. The partition guide part 182 airtightly contacts the partition wall 440 within the circulation flow path 400 to divide the circulation flow path 400 up to a desired height.

Meanwhile, in the present invention, there are two ways that the outside air is introduced, and the first is direct introduction into the storage compartment 180 through the door 150, and the second is introduction through the lower filter 161. The first is the main method, and the second may be optionally included.

The first method, i.e., the introduction through the door 150 will be described.

Referring to the front of the storage compartment 180, the door 150 is positioned on one surface in contact with the outside air, at which the filter 151 is also positioned. Accordingly, the outside air introduced by passing through the filter 151 is directly introduced into the storage compartment 180.

The multi-functional storage system in the related art adopts the method of introducing outside air into the machine compartment, (a) shown in FIG. 4, rather than the storage compartment. In this case, the machine compartment should have a certain level of height in order to secure the area for air introduction and the area for filter. Since the small-size multi-functional storage system is proposed according to the present invention, in order to remove the height of the machine compartment, the outside air is made to be directly introduced into the storage compartment 180. Since the outside air is introduced into the storage compartment 180 without going through the machine compartment, when the outside air is heavily laden with pollutants, they can be directly introduced into the storage compartment 180, and in consideration of this, the performance of the filter 151 is ensured and the filter door 152 is additionally used.

The second method, i.e., the introduction through the lower filter 161 will be described. It is a method of selectively introducing air.

Figure 11:
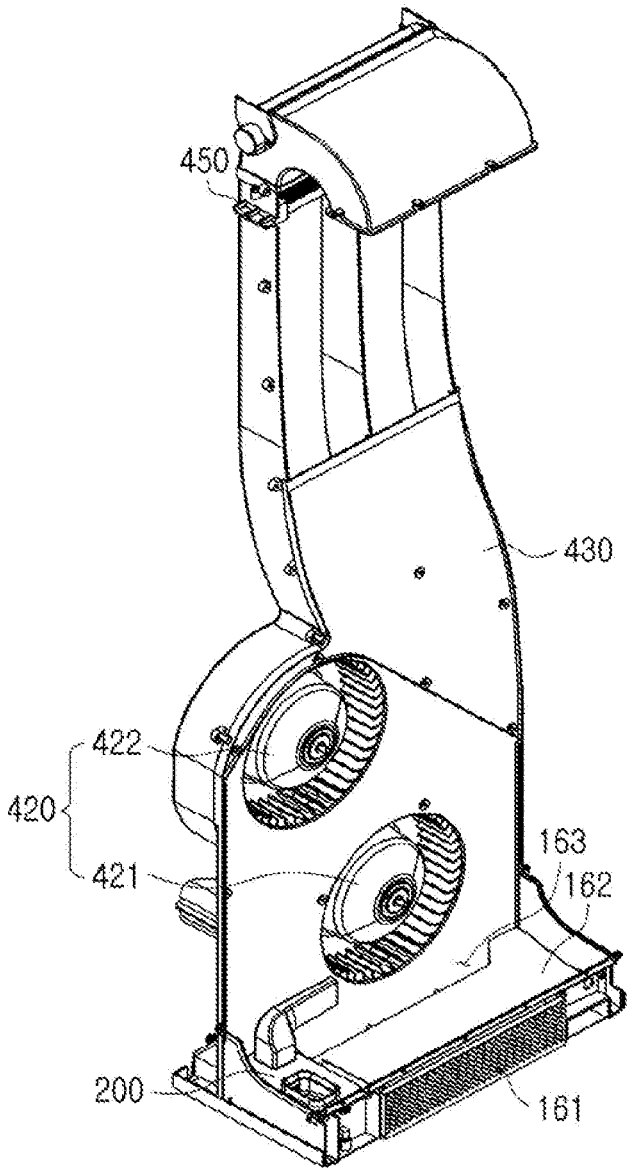
FIG. 11 is a perspective view provided to explain the humidifying unit and a lower flow path in the multi-functional storage system according to the present invention.

As well illustrated in FIG. 11, the lower filter 161 is positioned under the storage compartment 180. That is, it is positioned on the outer surface of the storage compartment 180 in a position other than the outer surface where the filter 151 is provided. The air introduced through the lower filter 161 passes through the lower flow path 163 divided by a lower separation plate 162 to reach the flow path inlet 300. Accordingly, the outside air introduced through the lower filter 161 directly reaches the flow path inlet 300 and the circulation flow path 400 without passing through the storage compartment 180.

Compared to the first method, there is a difference in that air is introduced into the flow path without passing through the storage compartment 180, meaning that this can be utilized in various ways. For example, when a large amount of outside air is required to be introduced or when both the clean air discharge and the air circulation for clothes management are required at the same time, the second method may be used together with the first method through the filter 151 (see FIG. 19B). In addition, even when the filter door 152 is closed and air introduction through the storage compartment 180 is impossible, a cleaning mode operation to be described below is possible (refer to FIG. 19D).

3.2 Humidifying Unit 200

Figure 9:
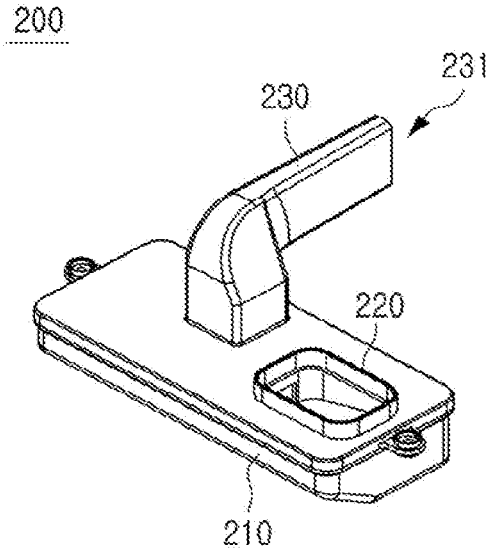
FIG. 9 is a perspective view of a humidifying unit in the multi-functional storage system according to the present invention.
Figure 10:
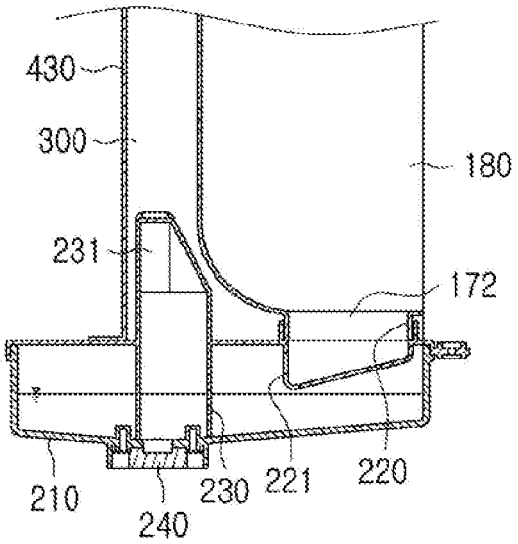
FIG. 10 is a cross-sectional view of the humidifying unit in the multi-functional storage system according to the present invention, taken along B-B' of FIG. 7.

The humidifying unit 200 will be described with reference to FIGS. 9 to 11.

The humidifying unit 200 includes the water tank 210, the humidifying unit inlet flow path 220, the humidifying unit exhaust flow path 230, and an ultrasonic vibrator 240.

The water tank 210 contains water up to a certain height. The height of the contained water can be detected using a separate water level sensor (not illustrated), and the like, so that it is possible to control that the water is contained up to the height desired by the manufacturer. Alternatively, the maximum water level may be guided to the user through prints on the water tank 210. The user may use a cup to additionally supply water to the water tank 210, or may detach the water tank 210 from the multi-functional storage system, fill it with water, and then install it again.

The humidifying unit inlet flow path 220 is a flow path through which the circulating air inside the storage compartment 180 is introduced into the humidifying unit 200. To this end, the upper end of the humidifying unit inlet flow path 220 is airtightly connected to the humidifying unit inlet 172 of the storage compartment 180.

A circulating air inlet 221 is positioned at the lower side of the water tank 210 of the humidifying unit inlet flow path 220. Through this, the circulating air inside the storage compartment 180 is introduced into the water tank 210.

The ultrasonic vibrator 240 is provided inside the water tank 210. The ultrasonic vibrator 240 forms humid air using water in the water tank 210, so that the upper part of the water surface is filled with the humid air. In another embodiment of the present invention, the humid air may be provided in another manner without the ultrasonic vibrator. For example, a humidifying filter or the like may be used. The lower end of the humidifying unit exhaust flow path 230 is positioned inside the water tank 210, or more specifically, below the water level of the water tank 210, and a humidified air discharge port 231 is positioned at the upper end and connected into the flow path inlet 300. Therefore, as the circulating air passes through the circulating air inlet 221 and is introduced into the water tank 210, the humid air formed and filled inside the water tank 210 is pushed and discharged to the flow path inlet 300 through the humidified air discharge port 231.

In this case, since the lower end of the humidifying unit exhaust flow path 230 is positioned below the water level in the water tank 210, even when a high pressure flow is formed by the fan 420, the phenomenon that the air is introduced into the water tank 210 is prevented. In other words, the humid air generated by the humidifying unit 200 is supplied to the circulation flow path 400 under any pressure condition, and the phenomenon that the circulating air on the circulation flow path 400 flows back into the humidifying unit 200 is prevented.

In one embodiment, when the humidifying unit 200 is positioned on the left side when viewed from the front, for more smooth discharge of the humidified circulating air, the humidifying unit exhaust flow path 230 may have a shape bent in an L-shape toward the right (see FIG. 11).

In one embodiment, in order to more smoothly discharge the humidified circulating air, the humidifying unit exhaust flow path 230 may have a shape in which the cross-sectional area is gradually narrowed from the water tank 210 toward the humidified air discharge port 231.

3.3 Flow Path Inlet 300

Figure 12:
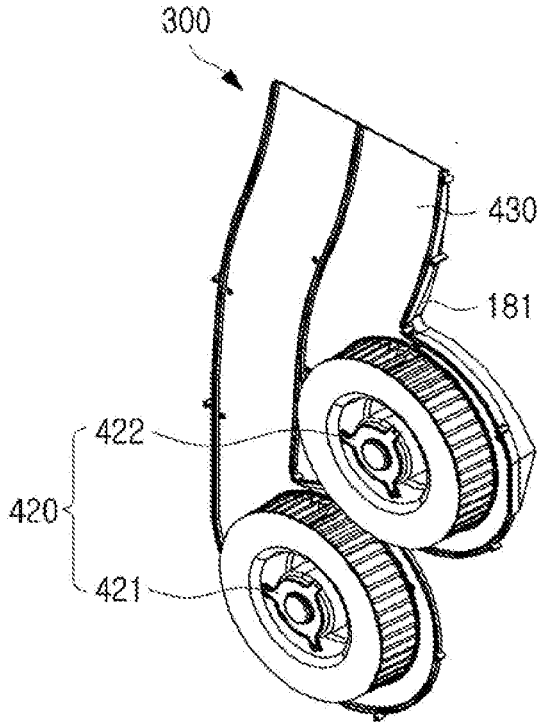
FIG. 12 is a perspective view of a flow path inlet in the multi-functional storage system according to the present invention.
Figure 13:
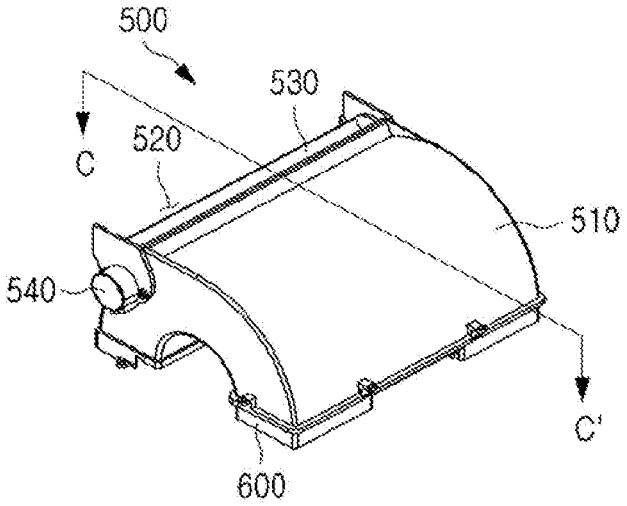
FIG. 13 is a perspective view provided to explain a variable flow path module of the multi-functional storage system according to the present invention.
Figure 14:
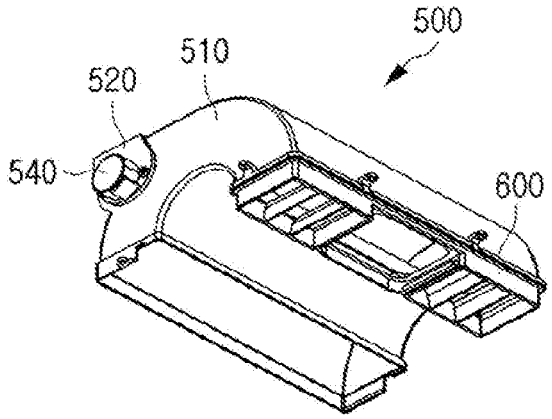
FIG. 14 is a bottom perspective view provided to explain the variable flow path module of the multi-functional storage system according to the present invention.

The flow path inlet 300 will be described with reference to FIG. 12.

The flow path inlet 300 is a space where the circulating air humidified by the humidifying unit 200 is introduced into the circulation flow path 400. As the circulating air discharged through the humidifying unit exhaust flow path 230 spreads over a large area in the flow path inlet 300, the circulating air is relatively evenly distributed to each of the plurality of fans 420. When there is no flow path inlet 300, most of the circulating air is introduced into one fan 420 that is closest to the humidifying unit exhaust flow path 230, and in this case, the load may be focused on only the one of the plurality of fans 420, which may adversely affect the life of the equipment.

The flow path inlet 300 utilizes the space between the circulation flow path 400 and the storage compartment 180. In other words, the flow path inlet 300 is positioned at the rear of the storage compartment 180 and at the front of the circulation flow path 400.

Among the plurality of fans 420 of the flow path inlet 300, a horizontal cross-sectional area of the fan positioned at the lower side of the storage compartment 180 side may be formed to be wider than the horizontal cross-sectional area of the fan positioned at the upper side.

The flow path inlet 300 may have an upwardly tapered shape, and in this case, the storage compartment 180 may be formed to correspond to the flow path inlet 300.

With the flow path inlet 300 formed as described above, compared to when there is no difference in the cross-sectional area of the upper and lower sides, the moving distance of air is reduced, and this allows the air to flow more quickly to the plurality of fans 420 positioned at the upper side, thereby allowing more even distribution of the air to each of the plurality of fans 420.

Figure 5:
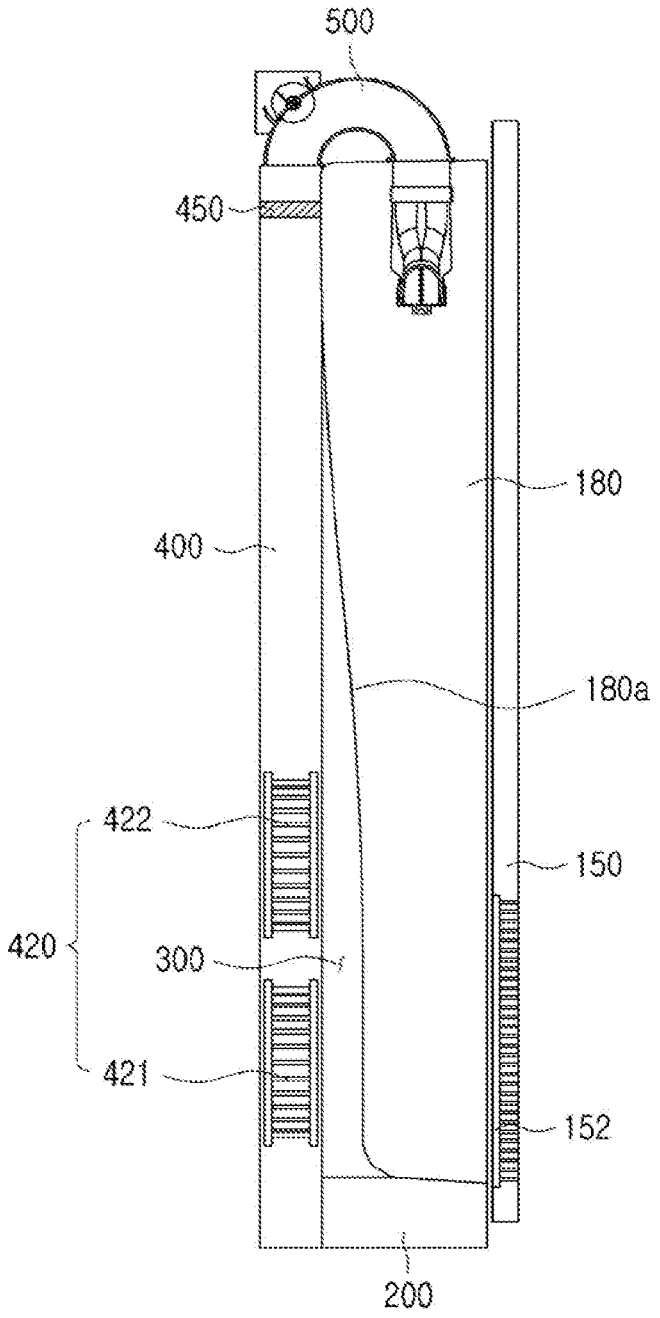
FIG. 5 is a cross-sectional view of the multi-functional storage system according to the present invention, taken along line A-A' of FIG. 1.

As described above, the storage compartment 180 shaped such that the cross-sectional area in the horizontal direction is narrowed toward the lower side, and the space generated from this is utilized (refer to FIG. 5). In other words, the flow path inlet 300 is positioned in a space positioned between the outermost edge and the innermost edge of the storage compartment 180. Accordingly, there is no need to secure a separate additional space for forming the flow path inlet 300, which is an important advantage for forming a small-size multi-functional storage system.

One surface of the flow path inlet 300 in the front direction is the rear surface of the storage compartment 180, and one surface of the flow path inlet 300 in the rear direction is the outer surface of the circulation flow path 400 in the front direction.

Referring to the sidewall of the flow path inlet 300, a portion of the side surface is the guide flow path guide part 181 provided on the rear surface of the storage compartment 180, and the other portion is a portion protruding from the circulation flow path 400.

An opening is formed in the portion corresponding to the fan 420 on the outer surface of the circulation flow path 400, and through this, the circulating air introduced into the flow path inlet 300 is introduced into the circulation flow path 400. When the plurality of fans 420 are included, since a plurality of openings are provided for each of the plurality of fans 420, the circulating air can be uniformly introduced through the plurality of openings such that the circulating air can be evenly introduced into the plurality of fans 420.

3.3-1 Inclined Flow Path Inlet 300

Details of the structure of the flow path inlet 300 described above will be described with reference to FIGS. 5 to 8.

As described above, according to the present invention, the circulation flow path 400 is disposed at the rear of the storage compartment 180 in order to minimize the volume. The circulation flow path 400 is in communication with the lower portion of the storage compartment 180, and there is the flow path inlet 300 formed between the rear surface of the storage compartment 180 and the circulation flow path 400, into which the circulating air is introduced from the storage compartment 180.

Rather than being formed as a separate configuration, the flow path inlet 300 is preferably formed as a space between the rear surface of the storage compartment 180 and the front surface of the circulation flow path 400. The plurality of fans 420 are provided in the circulation flow path 400 extending upward from the rear of the storage compartment 180, and the embodiment of the present invention will be described below by referring to an example where the first fan 421 and the second fan 422 are provided.

The first fan 421 and the second fan 422 are positioned at different heights along the extending direction of the circulation flow path 400, in which the first fan 421 is positioned at the lower portion, and the second fan 422 is positioned above the first fan 421. This is to minimize the space (especially the thickness) occupied by the dual fan installation.

When both the first fan 421 and the second fan 422 are operated, more circulating air may be sucked toward the first fan 421 relatively closer to the lower portion of the storage compartment 180, and since the first fan 421 and the second fan 422 are positioned diagonally to each other, when the amount of circulating air introduced into the first fan 421 and the second fan 422 differs, the amount of circulating air discharged from the left and right sides may also differ in the flow path guide 600 positioned above the storage compartment. Accordingly, since it is necessary to balance the amount of circulating air to be sucked into the first fan 421 and the second fan 422, the present invention balances the amount of circulating air to be sucked into the first fan 421 and the second fan 422 by forming the flow path inlet 300 that is inclined in a certain direction.

As described above, since the flow path inlet 300 is the space formed between the rear surface of the storage compartment 180 and the front surface of the circulation flow path 400, the shape of the flow path inlet 300 varies according to the shape of the rear surface of the storage compartment 180 and the front surface of the circulation flow path 400. Since the shape of the circulation flow path 400 is directly related to the flow of the circulating air, in the present invention, the shape of the rear surface of the storage compartment 180 has an inclined structure. An inclined portion 180*a* extends from a predetermined height on the rear surface of the storage compartment 180, in which the inclined portion 180*a* includes a portion facing the second fan 422 and is inclined toward the front surface of the circulation flow path 400. The flow path inlet 300 is formed in a structure in which the cross-sectional area in the horizontal direction decreases toward the upper side by the inclined portion 180*a*, and in other words, the space is gradually narrowed.

As described above, the rear surface of the storage compartment 180 has a shape that is recessed toward the storage compartment 180 in a downward direction, and when viewed based on the inside of the storage compartment 180, the space inside the storage compartment 180 is narrowed in a downward direction. Because the clothes hangers 700 for hanging the clothes are positioned in the upper direction in the multi-functional storage system, the space inside the storage compartment 180 is more important in the upper direction for user convenience and for securing a space for cleaning the clothes. With this structure, the present invention can achieve both the user convenience and the minimization of the volume of the multi-functional storage system.

In addition, when viewed from the side of the circulating air flow inside the storage compartment 180, as the circulating air flows toward the lower side of the storage compartment 180 to be discharged, due to the narrowing inner space, the discharge pressure of the circulating air at the outlet end of the storage compartment 180 can be increased, and through this, it is possible to smoothly circulate the circulating air between the storage compartment 180 and the circulation flow path 400.

The dual fans 421 and 422 provided in the circulation flow path 400 according to the present invention are arranged to horizontally suck the circulating air introduced into the flow path inlet 300, and the circulating air sucked in the horizontal direction by the first fan 421 and the second fan 422 changes into a vertical direction (that is, upward) and flows in the circulation flow path 400.

As described above, the humidifying unit 200 of the present invention is not the structure branched off from the flow path of the circulating air, but the humidifying unit 200 itself forms a portion of the flow path of the circulating air such that the circulating air flows downward in the storage compartment 180 and sequentially passes through the humidifying unit 200.

At this time, since the area where the circulating air is discharged from the humidifying unit 200 (that is, the humidified air discharge port 231, see FIG. 9) is adjacent to the first fan 421 positioned at a relatively lower side, it is necessary to form an inclination in the space of the flow path inlet 300, that is, in the space for introducing the circulating air into the second fan 422. By forming an inclination on a portion of the rear surface of the storage compartment 180 that faces the second fan 422, the volume of the space directly affected by the second fan 422 can be reduced, and through this, it is possible to substantially increase the suction pressure of the circulating air to the second fan 422, and subsequently maintain a balance between the amount of suction of circulating air to the first fan 421 and the amount of suction of circulating air to the second fan 422.

Meanwhile, in a modification of the present invention, the inclined portion 180*a* may be formed such that the inclined direction thereof corresponds to the diagonal direction, in consideration of the positions of the first fan 421 and the second fan 422 arranged in a mutually diagonal direction. That is, the inclined portion 180*a* is formed such that its inclined direction is not just one direction, but three-dimensional in consideration of the positional relationship between the first fan 421 and the second fan 422, so that the uniformity of the circulating air sucked into the first fan 421 and the second fan 422 may be improved.

The details of inclination angle of the inclined portion 180*a* according to the present invention may be determined in consideration of the outputs of each of the first fan 421 and the second fan 422 (for reference, the first fan 421 and the second fan 422 may be designed to have different output values), and may be optimally designed by further considering the positional relationship (distance and diagonal angle) between the first fan 421 and the second fan 422.

3.4 Circulation Flow Path 400

The circulation flow path 400 will be described with reference again to FIGS. 7 and 8.

The fan 420 is provided in the circulation flow path 400. By rotation, the fan 420 provides power to continuously circulate the circulating air.

One or more fans 420, or specifically, a plurality of fans are provided, although two fans 420 are illustrated in the drawing. In general, since the power of a fan is proportional to the diameter and thickness of the fan, in order to provide the necessary power in the small-size multi-functional storage system, it is preferable to include a plurality of fans smaller in size than one fan having a larger size. When three or more fans are provided, it may rather complicate the circulation flow path 400, and accordingly, the present invention employs two fans 420 are adopted as the optimal number. However, as far as it is within the spirit of the present invention, the scope of the present invention will not be limited to the number of fans 420.

In this case, the plurality of fans 420 may be positioned at different heights. In this case, the plurality of fans 420 may be alternately arranged. That is, the plurality of fans 420 may have different heights and may be alternately arranged rather than being simply stacked.

It may be said that the circulation flow path 400 is divided into an assembly part provided with the fan 420, and the guide flow path 410 part. The guide flow path 410 is again divided into a portion that is defined by the guide flow path partition wall 440 and a portion that is not.

A front side surface of each of the assembly parts of the plurality of fans 420 is in communication with the flow path inlet 300. Accordingly, the circulating air introduced into the flow path inlet 300 flows backward toward the fan 420 and enters the circulation flow path 400 of each of the assembly parts of the plurality of fans 420. In the example illustrated in FIG. 8, the air will enter each of the assembly parts of the two fans 420. In addition, as described above, the circulating air is evenly distributed and introduced into the assembly parts of the plurality of fans 420 due to the flow path inlet 300.

The circulating air entering each of the assembly parts of the plurality of fans 420 is moved along the guide flow path 410 by the power of the fan 420.

The guide flow path 410 is divided by a predetermined length by the guide flow path partition wall 440. The air entering each of the assembly parts of the plurality of fans 420 is divided by the length of the guide flow path partition wall 440 and flows.

The length of the guide flow path 410 divided by the guide flow path partition wall 440 can be variously adjusted. When the guide flow path partition wall 440 is short, the confluence of the air introduced from each of the assembly parts of the plurality of fans 420 is fast, and, conversely, when the guide flow path partition wall 440 is long, the confluence of the introduced air is delayed. When the confluence of the introduced air is fast, the air flows rapidly and statically, in which case heating by the heating unit 450 is possible. When the confluence of the introduced air is delayed, the heating may be relatively uneven because of dynamic flow, but on the other hand, this results in more complicated and random flows of the air introduced into the storage compartment 180, effectively removing dust from clothes. Accordingly, manufacturer may appropriately adjust the length of the guide flow path partition wall 440 in accordance with the specification of the product and the shape and length of the actual circulation flow path 400.

The length of the guide flow path partition wall 440 extending on the circulation flow path 400 may be determined according to the outputs and positions of the plurality of fans 420, but is not limited thereto.

The output of the plurality of fans 420 may mean the size and number of rotations of the plurality of fans 420, and the power of the fans, but is not limited thereto.

The heating unit 450 is positioned at a distal end of the guide flow path 410. The heating unit 450 heats the circulating air. Accordingly, the heated and humidified circulating air is introduced into the storage compartment 180. The heated and humidified circulating air performs a function of removing odor substances and contaminants from the clothes stored in the storage compartment 180.

In the drawing, the heating unit 450 is positioned in the guide flow path 410 without the guide flow path partition wall 440, but it may be positioned in the portion with the partition wall 440. In addition, the heating unit 450 is positioned in the circulation flow path 400, but it may be positioned in a portion of the variable flow path module 500 to be described below that is beyond the circulation flow path 400, and may be positioned at a portion after the exhaust flow path 520 is branched off from the variable flow path module 500. In this case, there is an advantage that all of the air heated by the heating unit 450 can flow to the storage compartment 180 without being discharged to the outside.

3.5 Variable Flow Path Module 500

The variable flow path module 500 will be described with reference to FIGS. 13 to 16.

The variable flow path module 500 partially or completely discharges the circulating air that passed through the circulation flow path 400 to the outside, or partially or fully introduces the circulating air into the storage compartment 180. In other words, one end of the variable flow path module 500 is connected to the circulation flow path 400, from which the circulating air is introduced, and the other end is connected to the storage compartment 180 through the flow path guide 600, from which the circulating air is discharged.

The variable flow path module 500 includes a variable flow path 510 connecting the circulation flow path 400 and the storage compartment 180, the exhaust flow path 520 branched off from the variable flow path 510, and in communication with the outside, and able to be selectively opened and closed, a variable guide 530 for changing the flow direction of the circulating air, and a power member 540 for providing power to the variable guide 530.

The variable guide 530 controls opening and closing of the branched exhaust flow path 520. The variable guide 530 may close the exhaust flow path 520 to allow all the circulating air to flow into the storage compartment 180 (FIG. 16A), or may open the exhaust flow path 520 to exhaust a portion of circulating air to the outside (FIG. 16B). At this time, when the flow path guide 600 to be described below is closed and the circulating air is not allowed to flow into the storage compartment 180, the circulating air is completely exhausted. The exhaust flow path 520 is opened and closed according to the control of the variable guide 530, which implements various operating modes of the multi-functional storage system according to the present invention, which will be described below with reference to FIG. 19.

In the present invention, since the circulation flow path 400 is installed at the rear of the storage compartment 180 for size reduction, the variable flow path 510 is formed in an inverted U-shape to connect the circulation flow path 400 and the storage compartment 180. However, the variable flow path 510 may have any shape as long as it can connect the circulation flow path 400 and the storage compartment 180.

The exhaust flow path 520 is branched off from the variable flow path 510. As described above, when the variable flow path 510 has an inverted U-shape, the exhaust flow path 520 may be positioned at one end of a corner where the curve is formed.

Figure 16A:
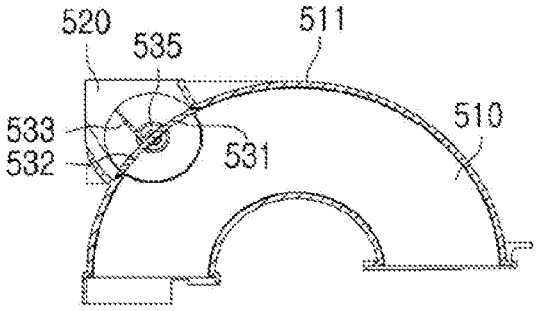
FIGS. 16A and 16B are cross-sectional views provided to explain the variable flow path module of the multi-functional storage system according to the present invention, taken along C-C' of FIG. 13.
Figure 16B:
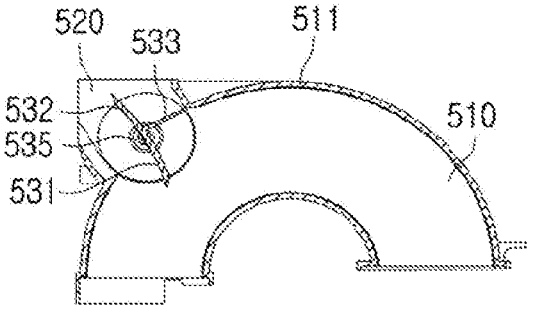

The shape of the variable flow path 510 and the exhaust flow path 520 is more clearly illustrated in FIG. 16A.

The variable guide 530 for determining a flow direction of air is provided at a portion where the exhaust flow path 520 is branched.

Figure 15:
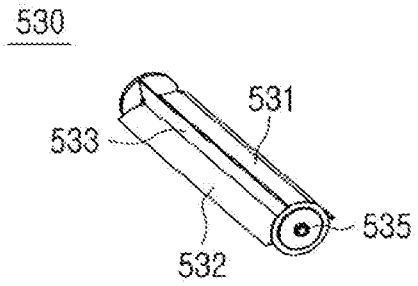
FIG. 15 is a perspective view provided to explain a variable guide of the variable flow path module of the multi-functional storage system according to the present invention.

As illustrated in FIG. 15, the variable guide 530 is rotatably driven and includes a first guide 531, a second guide 532, and a third guide 533 about a rotation shaft 535. The rotation shaft 535 is directly or indirectly connected to the power member 540 to be rotated.

When the rotation shaft of the variable guide 530 is positioned inside the variable flow path 510, since a large amount of load due to the air flowing during the rotation of the variable guide 530 is applied, it requires greater power and is also not good for equipment durability. Conversely, when the rotation shaft of the variable guide 530 is positioned outside the variable flow path 510, it is difficult to fabricate the variable flow path 510 in continuous shape whose inner surfaces are smoothly connected so as not to obstruct the flow of circulating air. A separate member is required.

Therefore, according to the present invention, rather than being inside or outside of the variable flow path 510, the rotation shaft 535 of the variable guide 530 is positioned on a boundary surface of the variable flow path 510, that is, it is positioned on an extension line of a variable flow path upper surface 511, and more specifically, it is positioned on the boundary surface where the exhaust flow path 520 branches off from the variable flow path 510. Through this, when the variable flow path 510 closes the exhaust flow path 520 (FIG. 16A), the flow of circulating air is not disturbed, and it also does not require much power to operate the variable guide 530.

When the variable flow path 510 closes the exhaust flow path 520 (FIG. 16A), in order to ensure that the variable guide 530 does not interfere with the flow of circulating air, a guide for closing the exhaust flow path 520, that is, the inner surfaces of the first guide 531 and the second guide 532 preferably have a shape continuous with the inner surface on the extension line of the variable flow path upper surface 511.

In addition, as well illustrated in FIG. 16A, the first guide 531 preferably has a shape protruding from inside, while having a longer inner cross-section than an outer cross-section, and correspondingly, a portion of the variable flow path upper surface 511 in contact with the first guide 531 preferably has a shape protruding from outside, while having a longer outer cross-section than an inner cross-section. This prevents the phenomenon that the circulating air is exhausted by the undesirable rotation of the variable guide 530 by the circulating air as the circulating air flows. As illustrated in FIG. 16A, when the variable guide 530 closes the exhaust flow path 520, although a portion of the circulating air flowing in the counterclockwise direction based on the drawing may flow toward the variable guide 530 and pass through, the variable guide 530 is not opened due to the shape of the first guide 531, and rather has an increased degree of airtightness.

For the same reason, the second guide 532 has a shape protruding from outside, while having a longer outer cross-section than an inner cross-section, and correspondingly, a portion of the variable flow path upper surface 511 in contact with the second guide 532 preferably has a shape protruding from inside, while having a longer inner cross-section than an outer cross-section.

When the variable guide 530 is rotated to open the exhaust flow path 520 (FIG. 16B), the third guide 533 comes into contact with the variable flow path upper surface 511 and performs a function of guiding the exhausted circulating air only in a certain direction.

In order for the third guide 533 to come into contact with the variable flow path upper surface 511 more efficiently, it is preferable that the fixed one end of the third guide is positioned on either the first guide 531 or the second guide 532, rather than on the rotation shaft 535. In other words, the rotation shaft of the third guide 533 is different from the rotation shaft 535 of the variable guide 530 and is partially eccentric. Through this, the length of the third guide 533 can be formed to be longer than the length from the rotation shaft 535 to the variable flow path upper surface 511, so that the third guide 533 can be press-fitted, thereby guiding the circulating air to be exhausted more effectively in only one direction.

Meanwhile, in the illustrated embodiment, the heating unit 450 is positioned on the circulation flow path 400, but in another embodiment of the present invention not illustrated, the heating unit 450 may be positioned on the variable flow path module 500. In particular, when the heating unit 450 is installed on the variable flow path module 500, but at the rear end of the portion where the exhaust flow path 520 is branched, it may be more effective to dehumidify the circulating air or the storage compartment 180 by introducing a portion of the air heated by the heating unit 450 into the storage compartment 180 without exhausting the same.

3.6 Flow Path Guide 600

Figure 17:
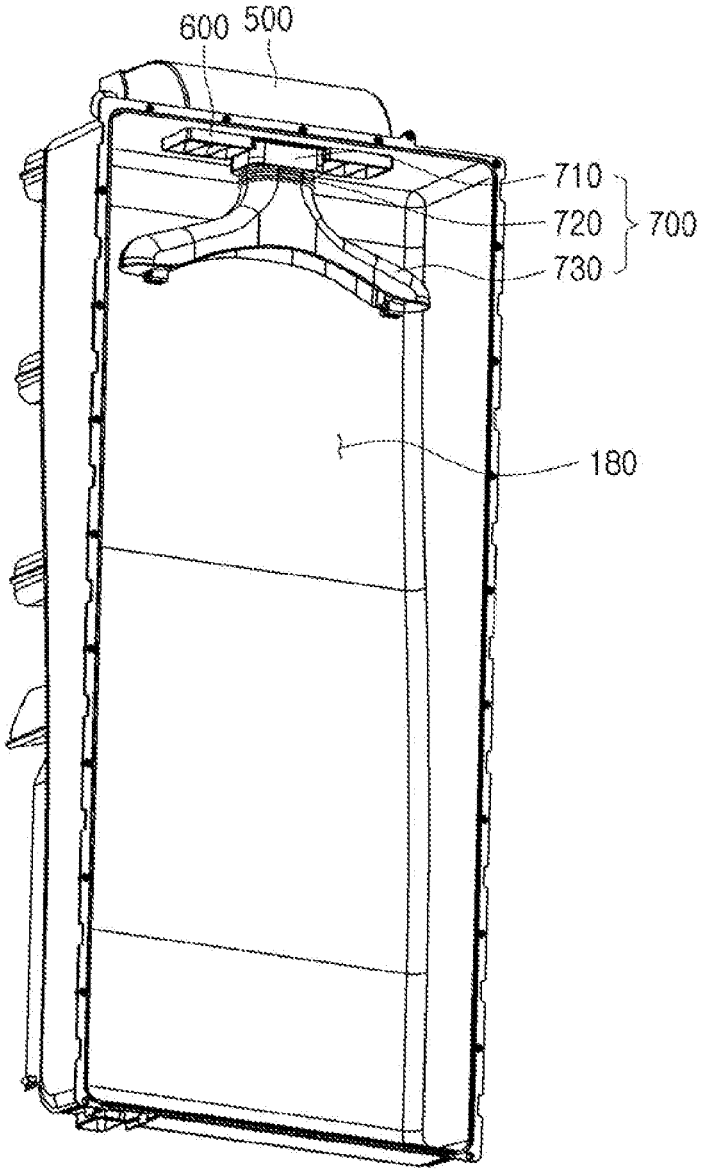
FIG. 17 is a bottom perspective view provided to explain the flow path guide of the multi-functional storage system according to the present invention.
Figure 18:
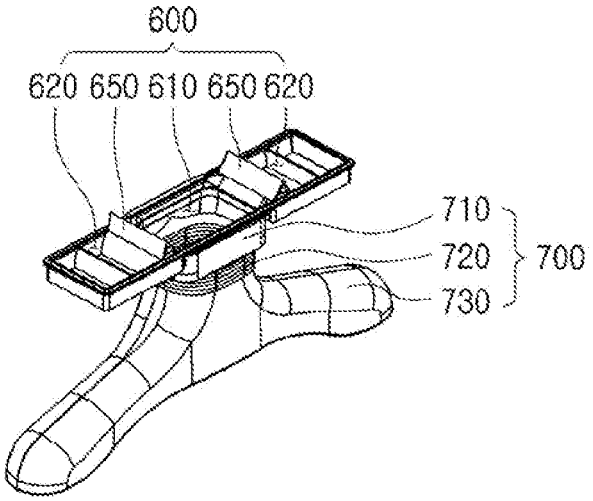
FIG. 18 is a perspective view of the flow path guide separated from the multi-functional storage system according to the present invention.

The flow path guide 600 will be described with reference to FIGS. 17 and 18.

The flow path guide 600 is installed in the upper opening 175 of the storage compartment 180, and connects a variable flow path 500 and the storage compartment 180.

The flow path guide 600 includes an air shot discharge port 610 for implementing a so-called "air shot" by discharging the circulating air into the clothes hanger 700 and shooting air onto the inner surfaces of the clothes hung, a storage compartment discharge port 620 for directly discharging the circulating air into the storage compartment 180 and outside the clothes hanger 700, and shooting the air onto the outer surfaces of the clothes hung, and a guide member 650 for ensuring that the circulating air is more efficiently guided toward the air shot discharge port 610 and the storage compartment discharge port 620.

The lower surface of the flow path guide 600 corresponds to the upper opening 175 of the storage compartment 180 and is airtightly connected.

The air shot discharge port 610 and the storage compartment discharge port 620 described above are positioned on the lower surface of the flow path guide 600. A coupling portion may be positioned at a lower end of the air shot discharge port 610, to which the clothes hanger 700 can be connected. A plurality of storage compartment discharge ports 620 may be provided. In order to evenly discharge the circulating air to the left and right sides of the clothes hung on the clothes hanger 700, the storage compartment discharge port 620 and the air shot discharge port 610 are preferably left and right symmetrical, and although there are one each on the left and right side in the drawing, it is to be noted that embodiments are not limited thereto.

An openable and closable grill may be positioned at each of the air shot discharge port 610 and the storage compartment discharge port 620, so that one or more discharge ports or all discharge ports may be selectively opened or closed as needed. It is also possible to implement various operating modes using this, which will be described below with reference to FIG. 19.

Since the guide member 650 should guide the circulating air to the respective discharge ports 610 and 620 after the circulating air flew throughout the entire upper surface of the flow path guide 600, the guide member 650 is preferably positioned at a boundary between the respective discharge ports 610 and 620, and also preferably has a triangular prism shape which is laid down to distribute the air.

3.7 Clothes Hanger 700

The clothes hanger 700 will be described with reference again to FIGS. 17 and 18.

The clothes hanger 700 includes a coupling portion 710 coupled to the flow path guide 600, an elastic portion 720 positioned at a lower end of a coupling portion 710 and formed of an elastic material, and a mounting portion 730 on which clothes are hung.

With the coupling portion 710, the clothes hanger 700 is attachable and detachable by the user. Therefore, the user may have convenience of detaching the clothes hanger 700, hanging the clothes on the clothes hanger and then attaching the clothes hanger back in the storage compartment 180 back. In addition, the user may also selectively use any one of various clothes hangers 700. In addition to the general clothes hanger illustrated in FIG. 18, various hangers may be used such as, without limitation, a trouser or skirt hanger, a two-piece hanger, and the like.

The elastic portion 720 allows the clothes hanger 700 to be shaken by the circulating air supplied into the storage compartment 180 through the flow path guide 600. Through this, it is possible to achieve the effect of brushing off contaminants from the clothes. In particular, as described above, the present invention has various structural features for forming a random flow of circulating air (a horizontal cross-sectional area of the storage compartment 180 is gradually narrowed from the upper side to the lower side, the circulation flow paths 400 of the two fans 420 which delay merging by use of the partition wall 440, and the like), which may be used together with the features described above for more effective removal of contaminants.

4. Description of Operating Modes of Multi-Functional Storage System

The operating modes of the multi-functional storage system according to the present invention will be described with reference to FIGS. 19A to 19D. It should be noted that the operating modes described herein are merely an example, and implementation of any other operating modes included in the spirit of the present invention described in the claims is also possible.

Figure 19A:
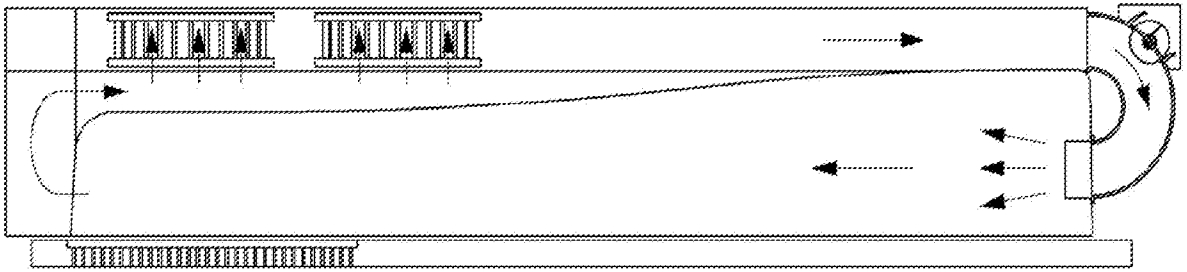
FIGS. 19A to 19D are conceptual views provided to explain various operating modes of the multi-functional storage system according to the present invention.

FIG. 19A illustrates the air flow in "circulating mode". The humidified high-temperature circulating air is introduced into the storage compartment 180. Using this can effectively remove contaminants and odor substances such as dust and the like from the clothes stored in the storage compartment 180.

Figure 19B:
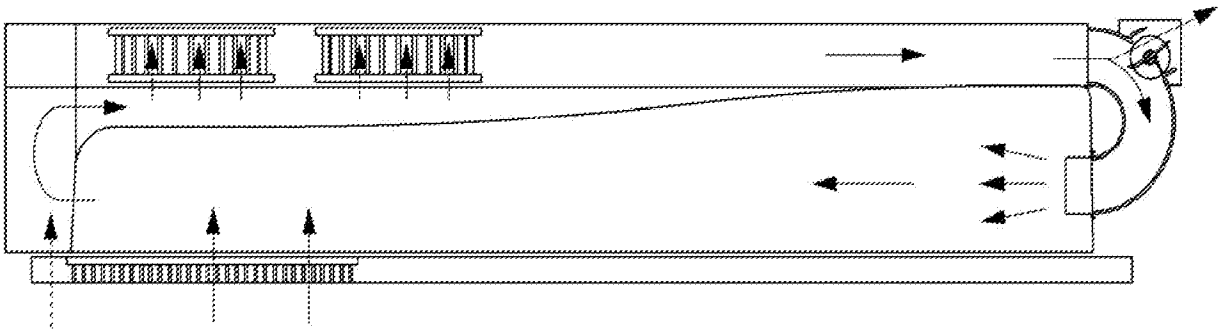

FIG. 19B illustrates the air flow in "air ventilation and cleaning mode". The contaminants and odor substances such as dust and the like are removed from the clothes stored in the storage compartment 180, and also a portion of the circulating air is exhausted to the outside. The circulating air exhausted to the outside is clean air that is filtered through the filter 151. In one embodiment, the air passed through the lower filter 161 may be further used.

Figure 19C:
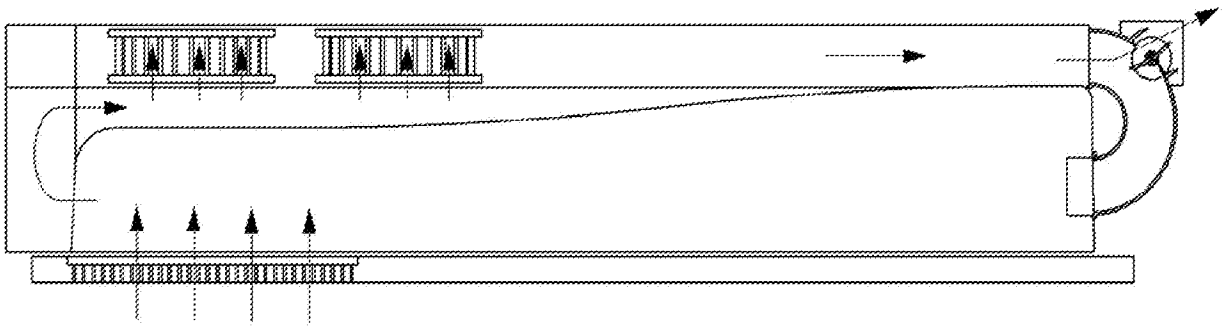

FIG. 19C illustrates the air flow in "cleaning mode". The humidified high-temperature circulating air is not introduced into the storage compartment 180. The clean air filtered through the filter 151 does not pass through the storage compartment 180 (passes only when introduced) but is completely exhausted, such that the system performs the same function as the air purifier. By variously controlling the operations of the humidifying unit 200 and the heating unit 450, it is possible to utilize not only the general cleaning mode, but also a humidifying cleaning mode, a dehumidifying cleaning mode, and the like.

Figure 19D:
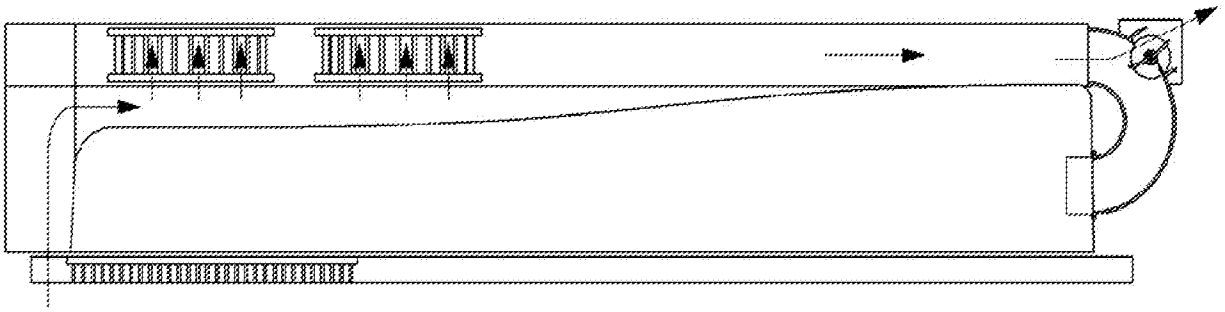

FIG. 19D illustrates the air flow in another embodiment of the cleaning mode. The air passed through the lower filter 161 is used and the air is not introduced into the storage compartment 180. This is suitable for protecting the clothes stored inside the storage compartment when the air quality outside the multi-functional storage system is poor (e.g., when there are cooking smells from the kitchen).

These operating modes may be variously combined or applied in various ways.

For example, the circulating mode may be operated for a predetermined time, and then the air ventilation and cleaning mode may be operated for a predetermined time, and when the multi-functional storage system is idle, the cleaning mode may be automatically operated.

When operating in the air ventilation and cleaning mode, the outside air may be introduced only through the filter 151, but when the quality of the outside air is poor and it is thus necessary to introduce a large amount of outside air and discharge a large amount of clean air, the outside air may also be introduced through the lower filter 161.

As another example, when it is detected that the quality of the outside air is poor during the cleaning mode operation, it may proceed in such a way that the filter door 152 is closed to prevent the outside air from being introduced into the storage compartment 180, thereby protecting the clothes stored therein and also introducing the outside air through the lower filter 161.

The operation of supplying the circulating air into the storage compartment 180, such as the cleaning mode or the air ventilation and cleaning mode, and the like may further perform a clothes management mode such as a dusting mode, a dewrinkling mode, and the like. This will be described below.

5. Description of Clothes Management Modes 5.1 Description of Configuration to Explain Clothes Management Modes In order to describe the clothes management mode, the configuration described above will be described again.

The plurality of fans 420 may be disposed below the circulation flow path 400 and may be arranged at a position where the circulation flow path 400 starts, but embodiments are not limited thereto.

The plurality of fans 420 may be positioned at the rear surface of the storage compartment 180.

The plurality of fans 420 may include first to N-th fans (N is a natural number equal to or greater than 2). Each of the first to N-th fans may be formed to discharge air to first to N-th positions in the space inside the storage compartment 180.

The air discharged from the first to n-th fans may be discharged into the storage compartment 180 and discharged toward the clothes hanger 700.

At this time, the air discharged from the first to n-th fans may all come into contact with different positions on the clothes hanger 700 to change the center of gravity of the clothes hanger 700.

Figure 20A:
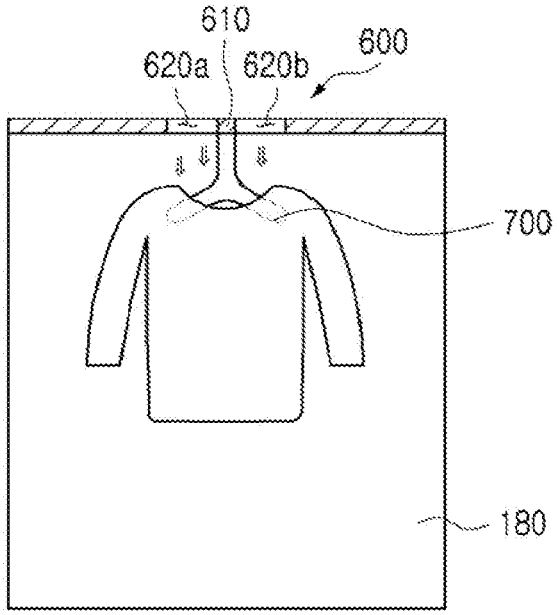
FIGS. 20A and 20B are conceptual views provided to explain a flow rate of circulating air at a storage compartment discharge port of the multi-functional storage system according to the present invention.

For example, when N is 2, the air discharged from the first fan 421 and the second fan 422 may be discharged toward the right and left sides, respectively, to the upper side of the clothes hanger 700 as shown in FIG. 20A, and at this time, when the flow rates applied to the right and left sides of the clothes hanger 700 is different from each other, the clothes hanger 700 is shaken up and down to change the center of gravity.

That is, the plurality of fans 420 may include first to N-th fans, and may change the center of gravity of the clothes hanger 700. A detailed description thereof will be described below.

In this case, the first to n-th fans may have different positions and outputs, but embodiments are not limited thereto.

In this case, the outputs of the plurality of fans 420 including the first to N-th fans may be independently controlled.

In this case, each of the plurality of fans 420 including the first to N-th fans does not necessarily mean the same fan.

At this time, as the number N of the first to N-th fans increases, the discharge positions also increase to the first to N-th positions, which may result in a vortex in the storage compartment 180.

The plurality of fans 420 are formed to discharge air upwardly onto the circulation flow path 400, and each of the first to N-th fans may be provided at different positions with respect to the plane.

In this case, each of the first to N-th fans may be provided at different heights, but embodiments are not limited thereto.

A portion of the circulation flow path 400 is divided by the guide flow path partition wall 440 such that the circulating air introduced by each of the plurality of fans 420 is divided and flows, and the outlet side of each of the plurality of fans 420 is in communication with each of the divided portions of the circulation flow path 400 divided by the guide flow path partition wall 440, and each of the divided portions is in communication with the flow path guide 600.

In this case, as described above, the length of the guide flow path partition wall 440 may be adjusted.

A variable partition wall 441 may be formed in a portion of the guide flow path partition wall 440. The variable partition wall 441 may be rotated left and right about a rotation shaft 442.

The variable partition wall 441 may close any one of the divided portions of the circulation flow path 400.

Figure 22A:
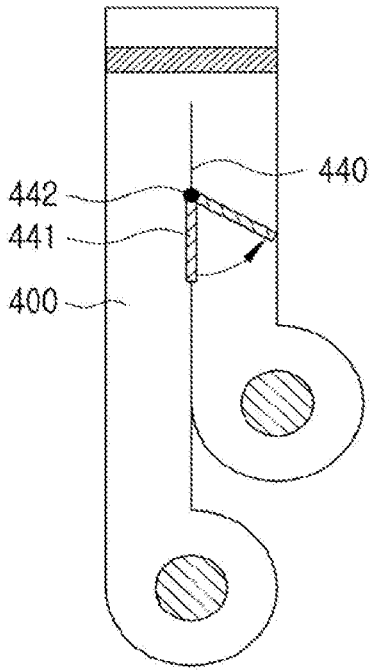
FIG. 22 is a conceptual view provided to explain a variable partition wall of the multi-function storage system according to the present invention.
Figure 22B:
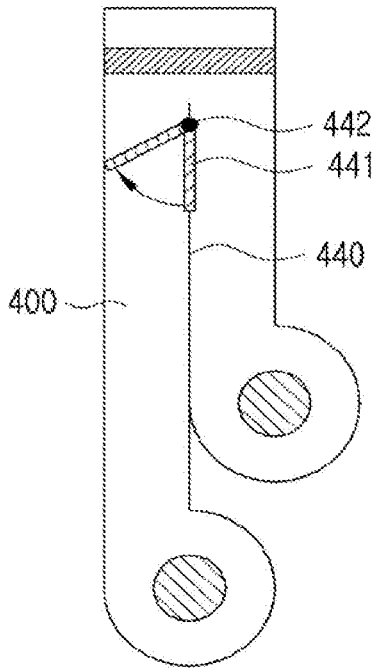

In this case, the position of the variable partition wall 441 is not limited to any specific position, and it may be formed as a part of the guide flow path partition wall 440 as long as it can be installed. For example, in FIGS. 22A and 22B, the position of the variable partition wall 441 is different.

The length of the variable partition wall 441 may be set to a length sufficient to close any one of the divided portions of the circulation flow path 400, and may be controlled or fixed to maintain a closed state against the flow of air hitting the variable partition wall 441.

The rotation of the variable partition wall 441 will be described below.

When N is 2, as the circulation flow path 400 is divided by the guide flow path partition wall 440, the circulating air discharged from the first fan 421 may flow to the first position, and the circulating air discharged from the second fan 422 may flow to the second position.

In this case, the longer length of the guide flow path partition wall 440 in the circulation flow path 400 can lead into a higher possibility that the circulating air passed through each of the first fan 421 and the second fan 422 is not mixed.

When N is 2, the position at which air is discharged from a storage compartment discharge port 620*a* may mean the second position at which air is discharged by the second fan 422, and the position at which air is discharged from a storage compartment discharge port 620*b* may mean the first position at which air is discharged by the first fan 421, but embodiments are not limited thereto.

At this time, when the outputs of the first fan 421 and the second fan 422 are low, air can be sufficiently mixed in the variable flow path module 500 such that a considerable amount of circulating air passing through the second fan 422 may flow to the storage compartment discharge port 620*b*, and vice versa.

At this time, the circulating air flowing to the air shot discharge port 610 may be a mixture of air passing through all of the plurality of fans 420, but embodiments are not limited thereto.

5.2 Description of Clothes Management Mode

Hereinafter, each mode will be described in detail with reference to the accompanying drawings. The functions to be mainly described in each mode to be described below are particularly effective functions in the corresponding mode, and the functions of each mode may be implemented in other modes.

Hereinafter, although a plurality of fans 420 may be used in the present invention as described above, for the purpose of convenience, the following description will be described based on the assumption that N is 2, and that the first fan 421 and the second fan 422 are provided at different heights on the circulation flow path 400 as illustrated in the drawings, but embodiments are not limited thereto.

An operation of supplying outside air into the storage compartment 180 that may be performed in the cleaning mode or the air ventilation and cleaning mode, and the like will be described.

The clothes management mode, which is an operation performed by supplying outside air into the storage compartment 180 may include a dusting mode, a dewrinkling mode, a decontaminating mode, and the like.

In the dusting mode, it is possible to intensively perform the function of removing dust from outside and inside of clothes hung on the clothes hanger 700 in the storage compartment 180.

In the dusting mode, the outputs of the first fan 421 and the second fan 422 are set differently and vary, and it is repeated that the output of one of the first fan 421 and the second fan 422 is set higher than the other and then set lower than the other.

That is, as the outputs of the first fan 421 and the second fan 422 are set differently, a difference in the flow rate of the circulating air respectively flowing to the first position and the second position may occur, and accordingly, the clothes hanger 700 may shake up, down, left and right due to the difference in the flow rate of circulating air discharged to the left and right sides of the clothes hanger 700.

Figure 20B:
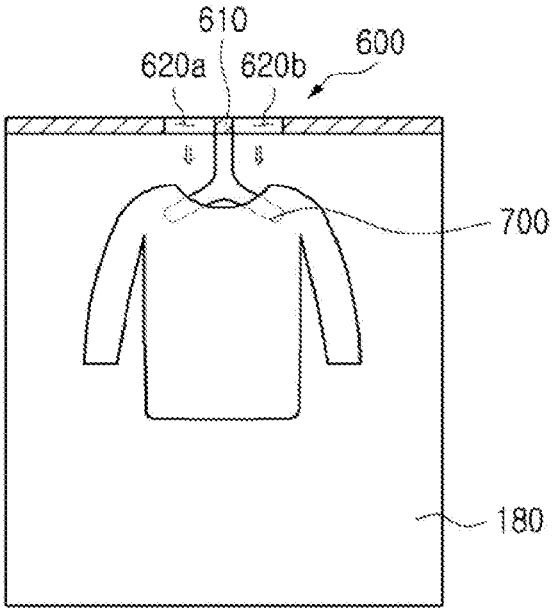
Figure 21:
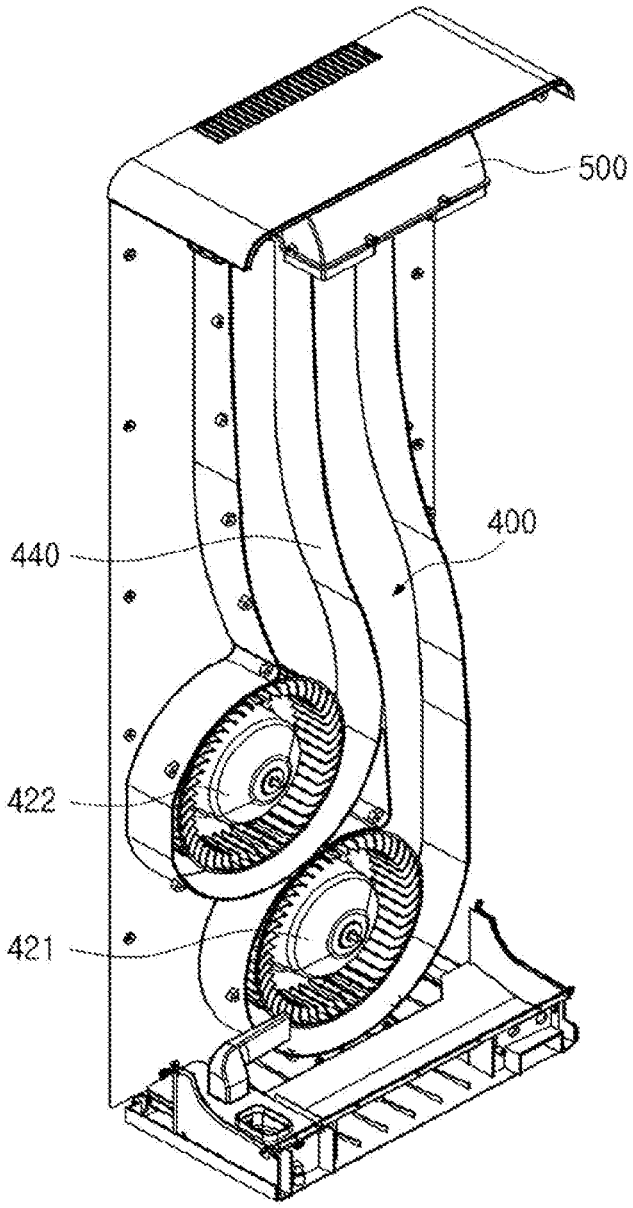
FIG. 21 is a perspective view of a partition wall of the multi-functional storage system according to the present invention.

For example, FIG. 20A illustrates that the flow rates discharged from each of the storage compartment discharge ports 620*a* and 620*b* are different and the flow rates are higher at the storage compartment discharge ports 620*a*, and FIG. 20B illustrates that the outputs of the first fan 421 and the second fan 422 are the same, so that the flow rate of the circulating air discharged to each of the storage compartment discharge ports 620*a* and 620*b* is the same.

In this case, when it is repeated that the outputs of the plurality of fans 420 are each set higher and then lower, this may mean that, for example, when the output of the first fan 421 is higher than the output of the second fan 422, it is repeated that the output of the first fan 421 is set lower than the output of the second fan 422 after a preset time, and then set higher again after the preset time.

In this case, the preset time interval does not always mean the same, and once the clothes hanger 700 is shaken and inertia occurs, the preset time interval may be further increased, but embodiments are not limited thereto.

At this time, the outputs of the first fan 421 and the second fan 422 may be set higher so as not to be mixed with each other, but mostly flow to each of the storage compartment discharge ports 620*a* and 620*b*, respectively, although embodiments are not limited thereto.

In addition, the dusting mode may be performed by controlling the operation of the variable partition wall 441.

The variable partition wall 441 may alternately close any one of the divided portions of the circulation flow path 400.

For example, FIG. 22 illustrates that the variable partition wall 441 closes any one of the divided portions of the circulation flow path 400.

When the variable partition wall 441 closes any one of the divided portions, the air discharged from the fan 420 positioned below the closed divided portion continues to output, but it flows to the open divided portion.

Accordingly, as any one of the divided portions is closed, the flow rate of the air discharged into the storage compartment 180 along the open divided portion positioned opposite to the closed divided portion increases.

As such, when the variable partition walls 441 alternately close the divided portions, the clothes hanger 700 may shake up, down, left and right due to a difference in the flow rate of circulating air discharged to the left and right sides of the clothes hanger 700.

At this time, the output of the fan 420 positioned opposite to the divided portion closed by the variable partition wall 441 may increase to further increase the flow rate of air, but embodiments are not limited thereto.

At this time, the output of the fan 420 positioned in the divided portion closed by the variable partition wall 441 may decrease, but embodiments are not limited thereto.

In the dewrinkling mode, it is possible to mainly perform a function of removing wrinkles on the outside and inside of clothes hung on the clothes hanger 700 in the storage compartment 180.

In the dewrinkling mode, the variable partition wall 441 may not be moved, and in the dewrinkling mode, air flowing from both sides of the first fan 421 and the second fan 422 may be sufficiently mixed.

At this time, in the dewrinkling mode, each of the outputs of the first fan 421 and the second fan 422 may be maintained the same.

As the pressure applied to the upper side of the clothes hanger 700 in the dewrinkling mode is the same, the clothes hanger 700 may not move left and right. As the clothes hanger 700 does not shake up, down, left and right, the pressure by the circulating air from the outside and the inside of the clothes can be continuously applied, and the air flow can regularly flow to effectively remove wrinkles on the clothes.

Meanwhile, the decontaminating mode may be additionally performed in addition to the dusting mode and the dewrinkling mode.

The decontaminating mode refers to a mode of intensively discharging circulating air to a direction of contamination, when clothes are contaminated inside or outside in a certain direction.

In the decontaminating mode, any one of the first fan 421 and the second fan 422 is set to have a higher output than the other, so that circulating air can be intensively discharged to the direction of contamination.

In addition, in the decontaminating mode, the variable partition wall 441 may close any one of the divided portions of the circulation flow path 400 to intensively discharge the circulating air to the specific direction of contamination.

At this time, the output of the fan 420 positioned opposite to the divided portion closed by the variable partition wall 441 may be increased to further increase the flow rate of air, but embodiments are not limited thereto.

In the above, the present invention is described with reference to the embodiments shown in the drawings to enable those skilled in the art to easily understand and reproduce the present invention, but this is merely exemplary, and those skilled in the art will be able to understand that various modifications and equivalent other embodiments are possible from the embodiments of the present invention. Therefore, the scope of protection of the present invention should be determined by the claims.

DESCRIPTION OF REFERENCE NUMERALS

110: upper surface
115: exhaust grill
120: side surface
130: rear surface
140: base
150: door
151: filter
152: filter door
161: lower filter
162: lower separation plate
163: lower flow path
171: storage compartment filter
172: humidifying unit inlet
175: upper opening
180: storage compartment
180*a*: inclined portion
181: guide flow path guide part
182: partition wall guide part
175: upper opening
200: humidifying unit
210: water tank
220: humidifying unit inlet flow path
221: circulating air inlet
230: humidifying unit exhaust flow path
231: humidified air discharge port
240: ultrasonic vibrator
300: flow path inlet
400: circulation flow path
410: guide flow path
420: fan
421: first fan
422: second fan
430: separation plate
440: guide flow path partition wall
441: variable partition wall
442: rotation shaft
450: heating unit
500: variable flow path module
510: variable flow path
511: variable flow path upper surface
520: exhaust flow path
530: variable guide
531: first guide
532: second guide
533: third guide
535: rotation shaft
540: power member
600: flow path guide
610: air shot discharge port
620: storage compartment discharge port
650: guide member
700: clothes hanger
710: coupling portion
720: elastic portion
730: mounting portion

The invention claimed is:

1. A multi-functional storage system, comprising:

a storage compartment;

a circulation flow path positioned at the rear of the storage compartment, and including an inlet end and an outlet end each communicating with the storage compartment, through which circulating air flows; and a flow path inlet for introducing the circulating air into the circulation flow path, the flow path inlet being positioned between the storage compartment and the circulation flow path and in communication with the inlet end of the circulation flow path, wherein the circulation flow path is formed to extend upward, and wherein the flow path inlet is a space formed between a rear surface of the storage compartment and a front surface of the circulation flow path and including at least a portion tapered upward, wherein the flow path inlet is formed in a shape corresponding to shapes of the rear surface of the storage compartment and the front surface of the circulation flow path, and a horizontal cross-sectional area of an upper portion is formed to be smaller than a horizontal cross-sectional area of a lower portion, wherein the circulation flow path includes a plurality of fans communicating with the flow path inlet, the plurality of fans including:

a first fan communicating with the lower portion of the flow path inlet; and a second fan communicating with the upper portion of the flow path inlet, and the first fan and the second fan are configured to suck in the circulating air introduced into the flow path inlet in a horizontal direction and supply it onto the circulation flow path, wherein the rear surface of the storage compartment includes an inclined portion including a portion facing the second fan and configured to be inclined toward the front surface of the circulation flow path, and the flow path inlet is formed so as to be decreased in cross-sectional area by the inclined portion in the horizontal direction toward the upper side, wherein an inclination angle of the inclined portion toward the circulation flow path varies according to an output of each of the first fan and the second fan.

2. The multi-functional storage system according to claim 1, wherein the circulation flow path includes a plurality of fans communicating with the flow path inlet, the plurality of fans being arranged at different heights from each other, and arranged in a mutually diagonal direction.

3. The multi-functional storage system according to claim 1, wherein the inclined portion is configured to be inclined toward the front surface of the circulation flow path, and also inclined in a diagonal direction to correspond to the first fan and the second fan arranged in the mutually diagonal direction.

4. The multi-functional storage system according to claim 1, further comprising a humidifying unit having one end communicating with the flow path inlet and the other end communicating with the lower portion of the storage compartment, wherein the humidifying unit includes a flow path formed such that the circulating air flows sequentially through the storage compartment, the humidifying unit, and the flow path inlet, and the humidified air formed as passing through the humidifying unit is introduced into the flow path inlet.

5. The multi-functional storage system according to claim 1, wherein the circulation flow path includes a plurality of fans communicating with the flow path inlet, the plurality of fans include first to N-th fans, and each of the first to N-th fans is formed to discharge air to first to N-th positions in the space inside the storage compartment, and outputs of the first to N-th fans are each independently controlled.

6. The multi-functional storage system according to claim 5, wherein the plurality of fans are configured to discharge air upwardly onto the circulation flow path, and each of the first to N-th fans is provided at different positions with respect to a plane.

7. The multi-functional storage system according to claim 6, further comprising a guide flow path partition wall extending on the circulation flow path and dividing the circulation flow path such that the circulating air introduced by each of the plurality of fans is divided and flows, wherein an extension length of the guide flow path partition wall on the circulation flow path is determined according to the outputs and positions of the plurality of fans.

8. The multi-functional storage system according to claim 7, wherein the plurality of fans include a first fan and a second fan provided at different heights on the circulation flow path, and each of the first fan and the second fan is in communication with each of divided portions on the circulation flow path divided by the guide flow path partition wall to discharge air to a first position and a second position in the space inside the storage compartment, respectively.

9. The multi-functional storage system according to claim 8, wherein the multi-functional storage system has a dusting mode wherein the outputs of the first fan and the second fan are set differently and varied, and it is repeated that the output of one of the first fan and the second fan is set higher than the other output and then set lower than the other output.

10. The multi-functional storage system according to claim 8, wherein the multi-functional storage system has a decontaminating mode wherein any one of the first fan and the second fan is set to have a higher output than the other.

11. The multi-functional storage system according to claim 8, wherein the multi-functional storage system has a dewrinkling mode wherein the outputs of the first fan and the second fan are each set to be the same.

12. The multi-functional storage system according to claim 8, wherein the guide flow path partition wall includes a variable partition wall that is formed as a part of the guide flow path partition wall and is relatively rotatable with respect to the guide flow path partition wall about the rotation shaft, and the guide flow path partition wall closes any one of the divided portions of the circulation flow path by relative rotation of the variable partition wall with respect to the guide flow path partition wall.

13. The multi-functional storage system according to claim 12, wherein the multi-functional storage system has:

a decontaminating mode wherein the variable partition wall closes any one of the divided portions of the circulation flow path, and the output of the fan positioned opposite to the divided portion closed by the variable partition wall is increased; and a dusting mode wherein the variable partition wall alternately closes any one of the divided portions of the circulation flow path, and it is repeated that the output of the fan positioned opposite to the divided portion closed by the variable partition wall is increased, and the output of the fan positioned in the divided portion is decreased.

14. The multi-functional storage system according to claim 1, further comprising a heating unit installed in the circulation flow path and configured to heat the passing air.

15. The multi-functional storage system according to claim 1, wherein the inlet end of the circulation flow path is in communication with a lower portion of the storage compartment through a humidifying unit, the outlet end of the circulation flow path is in communication with an upper portion of the storage compartment through a variable flow path module, a portion of the humidifying unit is positioned in the lower portion of the storage compartment, a portion of the variable flow path module is positioned above the storage compartment, and a machine compartment including another portion of the humidifying unit, another portion of the variable flow path module, and the circulation flow path is positioned at the rear of the storage compartment.

16. The multi-functional storage system according to claim 15, wherein the variable flow path module includes an exhaust flow path that can be selectively opened and closed.

17. The multi-functional storage system according to claim 1, further comprising a filter positioned on one surface of the storage compartment in contact with the outside air, wherein a door of the storage compartment is provided on an outer surface of the storage compartment that has the filter positioned therein.

18. The multi-functional storage system according to claim 17, further comprising a lower flow path communicating with the flow path inlet to allow the outside air to be directly introduced into the flow path inlet without being introduced into the storage compartment, wherein:

a lower filter is installed on the lower flow path, the lower filter being positioned in a portion other than the outer surface of the storage compartment;

a portion of the outside air is introduced through the filter and then passes through the storage compartment, the humidifying unit, and the flow path inlet sequentially to reach the circulation flow path; and another portion of the outside air is introduced through the lower filter and then passes through the flow path inlet to reach the circulation flow path.

* * * * *